US006335139B1

(12) United States Patent
Gambayashi et al.

(10) Patent No.: US 6,335,139 B1
(45) Date of Patent: Jan. 1, 2002

(54) TONER FOR ELECTROSTATIC IMAGE DEVELOPMENT AND IMAGE FORMING METHOD EMPLOYING THE SAME

(75) Inventors: Hideki Gambayashi, Ageo; Masanobu Nakamura, Warabi; Toshiro Kogawara, Iwatsuki; Shinji Amaya, Urawa, all of (JP)

(73) Assignee: Dainippon Ink and Chemicals, Inc., Tokyo (JP)

( * ) Notice: Subject to any disclaimer, the term of this patent is extended or adjusted under 35 U.S.C. 154(b) by 0 days.

(21) Appl. No.: 09/642,936

(22) Filed: Aug. 22, 2000

(30) Foreign Application Priority Data

Nov. 22, 1999 (JP) ..... 11-330977

(51) Int. Cl.[7] ..... G03G 9/087
(52) U.S. Cl. ..... 430/111.4; 430/97
(58) Field of Search ..... 430/106, 109, 430/110, 111, 111.4, 97

(56) References Cited

U.S. PATENT DOCUMENTS 5,541,030 A * 7/1996 Sano et al. ..... 430/110
5,837,416 A * 11/1998 Tavernier et al. ..... 430/111
6,100,000 A * 8/2000 Anno et al. ..... 430/111

FOREIGN PATENT DOCUMENTS

| | | |
|---|---|---|
| JP | 3-7948 | 1/1991 |
| JP | 4-97366 | 3/1992 |
| JP | 4-362956 | 12/1992 |
| JP | 5-119509 | 5/1993 |
| JP | 11-190913 | 7/1999 |

* cited by examiner

*Primary Examiner*—John Goodrow
(74) *Attorney, Agent, or Firm*—Armstrong, Westerman, Hattori, McLeland & Naughton, LLP

(57) ABSTRACT

The present invention provides a toner for electrostatic image development which reconciles anti-offset properties and fixation properties and is superior in resistance to abrasion and peel of the fixed image in uses where the development and fixation are conducted at a wide range of a fixing speed, particularly high speed which exceeds 20 or 30 m/min. The toner comprises a polyester resin, a colorant, and a releasing agent, wherein the flow beginning temperature Tfb of the toner as measured by a constant load extrusion type capillary rheometer is within a range of 70–105° C. and the flow ending temperature Tend is within a range of 120–144° C.

19 Claims, 1 Drawing Sheet

TONER FOR ELECTROSTATIC IMAGE DEVELOPMENT AND IMAGE FORMING METHOD EMPLOYING THE SAME

BACKGROUND OF THE INVENTION

1. Field of the Invention

The present invention relates to a toner for electrostatic image development which is employed in electrophotographic methods, electrostatic recording methods, and electrostatic printing methods.

2. Description of Related Art

Various electrophotographic methods have been disclosed in, for example, U.S. Pat. No. 2,297,691, Japanese Patent Application, Second Publication No. Sho 42-23910, and Japanese Patent Application, Second Publication No. Sho 43-24748; commonly, an electrostatic latent image is formed on an electrostatic latent image bearing medium such as a photoconductive photosensitive medium or the like by means of charge or light exposure, and then this electrostatic latent image is developed employing a toner composition containing a colorant in a binder resin, and the resulting toner image is transferred to a support medium such as transfer paper or the like and fixed, and a visible image is thus formed.

Apparatuses employing such an electrostatic image development method include copying machines, printers and the like. The processing speed varies depending on the manufacturer and type, but apparatuses having processing speeds corresponding to 30 sheets per minute in the case of office printers or about 60–100 sheets per minute in the case of office copying machines, when converted to printing speed on A4 size paper, are common. Due to increases in the speed of the developing apparatuses, conventional developing apparatuses have recently been replaced by high-speed apparatuses which have a processing speed corresponding to 100 sheets per minute when converted to a printing speed on A4 size paper in a longitudinal direction and 140 sheets per minute when converted to a printing speed on A4 size paper in a lateral direction, and which have fixing speeds of 30 m/min.

Due to power saving measure, the heat applied to the fixation of the toner has been reduced steadily, thereby reducing the heat applied from the heat roll during the fixation and shortening the pressing time due to the heat roll, thus making good sharp melting properties and low temperature fixing properties indispensable.

Also in high-speed apparatuses, there is a high possibility that the developed image makes contact with the heat roll for a long period of time if a problem occurs and that it will be exposed to excess calories, thus requiring sufficient anti-offset properties at high temperatures.

Accordingly, the toner for electrostatic image development employed therein requires a proper level according to the service conditions in electrical properties such as frictional charging properties and electric resistance related to the development and transfer properties, thermal properties related to fixation and anti-offset properties, and mechanical properties as powders such as fluidity, hardness and the like.

As the resin material for the powdered toner, for example, there have hitherto been investigated polyester, polystyrene, styrene-(meth)acrylic ester copolymer, styrene-butadiene copolymer, epoxy resin and the like, and various proposals have been made for the design of such resins depending on the use thereof.

With respect to resins for toners for fixing employing a heat roller, a lot of design examples have been proposed for the purpose of improving the fixation and anti-offset properties. To improve viscoelastic behavior during the melting by heating or to suppress changes in melt viscosity due to changes in temperature, various techniques such as enlargement of the molecular weight distribution, provision of a crosslinked structure, application of a rubbery elastic material and the like have been studied.

Due to energy reductions during the heat roll fixation or the enhancement of requirements for fixation properties at low temperatures accompanying the speeding up the apparatus, polyester resin has attracted special interest recently.

In research to date, it has been widely known that polyester resin may be employed as a resin for heat roller fixation. This is the case in, for example, Japanese Patent Application, Second Publication No. Sho 52-25420, Japanese Patent Application, Second Publication, No. Sho 53-17496, Japanese Patent Application, Second Publication No. Sho 55-49305 , Japanese Patent Application, First Publication No. Sho 55-38524, Japanese Patent Application, First Publication No. Sho 57-37353, Japanese Patent Application, First Publication No. Sho 58-11952, and the like.

However, in conventionally proposed inventions, when anti-offset properties are improved, it is not possible to avoid increases in the softening point or molecular weight of the resin, thereby degrading the anti-offset properties at low temperatures and fixation properties at low temperatures. On the other hand, when the anti-offset properties at low temperatures and fixation properties at low temperatures are improved, the softening point or molecular weight of the resin is lowered, thereby degrading the anti-offset properties at high temperatures and resistance to blocking.

A toner which reconciles these properties, which are in conflict with each other, with good balance is required. However, since properties such as anti-offset properties, fixation strength and charge characteristics vary drastically depending on the electrostatic image developing apparatus employing the toner and service conditions, design of the properties suited for these purposes is required.

Means for simply measuring the properties such as thermal characteristics and viscosity characteristics of the resin includes, for example, a constant load extrusion type capillary rheometer.

The constant load extrusion type capillary rheometer is employed for measuring the viscosity resistance in situations in which melt passes through a capillary tube, and specific examples thereof include Flow Tester "CFT-500" manufactured by Shimadzu Corporation.

The structure of the cylinder portion of this measuring apparatus is shown in FIG. 1.

In the drawing, the reference symbols 1 denotes a piston, 2 denotes a cylinder, 3 denotes a heater, 4 denotes a die, 5 denotes a die press, and 6 denotes a sample, respectively.

With regard to measurement by the temperature elevating method using this apparatus, measurement can be carried out continuously through out processes in which the sample 6 passes through a solid range, a transition range, a rubber elasticity range, and a fluidized range when testing while elevating the temperature at a fixed speed with the passage of the testing time. By employing this apparatus, the shear rate and viscosity at each temperature in the fluidized range can be simply measured.

The flowing curve by the temperature elevating method is shown in FIG. 2.

The range AB (softening curve) indicates a stage where the sample 6 is deformed by compression and inner pores are slowly reduced.

The point B is a temperature at which the inner pores disappear to form a transparent medium or phase having uniform appearance while maintaining a non-uniform stress distribution, and indicates an inflection point. This temperature is defined as a softening temperature Ts.

The range BC (terminating curve) indicates a range where the position of a piston 1 does not clearly change within a limited time and the sample 6 begins to flow through a die 4, and includes the rubber elasticity range of the sample 6. For a crystalline polymer, this range is short and the softening temperature shows a value close to a flow beginning temperature described hereinafter.

The point C indicates a temperature at which the sample 6 begins to flow through the die 4 as a result of a reduction in viscosity, and this temperature is defined as a flow beginning temperature Tfb.

The range CDE (flowing curve) indicates a range where the sample 6 flows through the die 4. In this range, in general, an irreversible viscous flow occurs.

The melting temperature T½ by the ½-process indicates a temperature at the half point of a piston stroke between Tfb and a flow ending temperature Tend in the flowing curve.

Any of the softening temperature Ts, flow beginning temperature Tfb, melting temperature T½ by the ½-process and flow ending temperature Tend defined herein exert an influence on the anti-offset properties and fixation properties at low temperatures during the fixation. Among these temperatures, the softening temperature Ts and flow beginning temperature Tfb contribute remarkably to the fixation properties at low temperatures and anti-offset properties at low temperatures, while melting temperature T½ by the ½-process and flow ending temperature Tend contribute remarkably to the anti-offset properties at high temperatures and pulverizability.

An invention made on the basis of the viscosity characteristics obtained by such a measuring method includes, for example, Japanese Patent Application, First Publication No. Hei 11-190913. The toner described in this publication is superior in anti-offset properties, but it is difficult to obtain sufficient fixation properties when employing the high-speed apparatus described above. That is, a polyester has still not been obtained which can be sufficiently employed in a high-speed apparatus whose fixing speed exceeds 20 or 30 m/min and simultaneously attain the anti-offset properties and fixation properties at low temperatures within a wide temperature range.

In the Examples of the above publication, the image of the toner is evaluated employing a high-speed copying machine (FT8200, manufactured by Ricoh Co., Ltd.), but the processing speed of the copying machine is 80 sheets per minute, when converted to printing speed on A4 size paper, and the fixing speed is about 16 m/min.

Additionally, in order to provide releasing properties from the heat roller during fixing, and in order to prevent the generation of offset, techniques have also been developed in parallel in which a releasing agent is included in the toner. To date, attention has centered on synthetic waxes such as polypropylene wax, polyethylene wax, and the like; however, examples have been disclosed in which a natural wax, such as montan wax, carnauba wax, rice wax, and the like have been employed, in Japanese Patent Application, First Publication No. Hei 1-238672, Japanese Patent Application, First Publication No. Hei 3-5764, and Japanese Patent Application, First Publication No. Hei 5-119509.

With respect to charge control agents, as well, various such agents have been considered, and a positive-charge charge control agent or a negative-charge charge control agent is selected depending on the development method and the polarity of the photosensitive medium. For example, nigrosine dyes and quaternary ammonium salt compounds and the like are known as charge control agents which may be employed in positively charged toner which is employed in machines using high speed and highly durable selenium photosensitive media. Examples in which such positive-charge charge control agents are used singly or in combination are disclosed in, for example, Japanese Patent Application, First Publication No. Hei 1-259371, Japanese Patent Application, First Publication No. Hei 3-7948, Japanese Patent Application, First Publication No. Hei 5-119509, and Japanese Patent Application, First Publication No. Hei 10-246991.

However, a discovery which exhibits all the characteristics required in the developing methods described above, for example, electrical properties such as frictional charging properties and electric resistance related to the development and transfer properties during the high-speed printing, thermal properties related to the fixation and anti-offset properties, and mechanical properties as powders such as fluidity, hardness and the like has not been disclosed in any of the referenced publications.

There have recently been demands for reduction of harmful substances generated from printers and copying machines, and the heavy metals contained in the toner in view of protection of the environment. With respect to the harmful substances generated from the printer and copying machine, impurities contained in the toner evaporate during the thermal fixation and are released into the environment. However, conventional toners were not designed with sufficient consideration of the content or generation of the harmful substances. Furthermore, some heavy metals or harmful substances of specific type and composition contained in the toner are liable to cause contamination of non-image portions and scattering of toner during printing, and consideration of them should be required in view of the printing characteristics of the toner. Consideration should also be given to countermeasures against environmental pollution and printing quality when compared with conventional printers and copying machines because the amount of the toner to be thermally fixed per unit of time is large in apparatuses for high-speed printing. However, a toner having sufficient countermeasures for these points has not yet been invented.

BRIEF SUMMARY OF THE INVENTION

An object of the present invention is to provide a toner for electrostatic image development which reconciles anti-offset properties and fixation properties and is superior in resistance to abrasion and peeling of the fixed image in uses where the development and fixation are conducted at a wide range of fixing speeds, particularly at high speeds which exceed 20 or 30 m/min.

Another object of the present invention is to provide a high-durability and long-life toner for electrostatic image development, which exhibits stable development and transfer properties without changing the frictional charging properties and electric resistance during high-speed printing when being employed as a toner for a two component developer, particularly printing at high speeds which exceed 20 or 30 m/min.

Still another object of the present invention is to provide a toner for electrostatic image development, which exhibits good fluidity during high-speed printing when employed as a toner for a two component developer, particularly during printing at high speeds which exceed 20 or 30 m/min, so that the toner is quickly miscible with a carrier after being fed to the printer and can quickly reach a predetermined charge amount, whereby it is capable of forming a printed image with high image quality and high definition, which is free from fogging.

A further object of the present invention is to provide a toner for electrostatic image development in which the content of heavy metals and polycyclic aromatic hydrocarbons is suppressed to as low as possible, and which releases as small an amount of harmful volatile components as possible during high-speed printing, particularly during printing at high speeds which exceed 20 or 30 m/min, so that it is capable of forming a printed image with high image quality and high definition, which is free from fogging and scattering of toner.

As a result of diligent research with the object of solving the problems described above, the present inventors have obtained the present invention.

That is, the present invention provides a toner for electrostatic image development comprising a polyester resin, a colorant, and a releasing agent, wherein the flow beginning temperature Tfb of the toner as measured by a constant load extrusion type capillary rheometer is within a range of 70–105° C. and the flow ending temperature Tend is within a range of 120–144° C.

The toner for electrostatic image development according to the present invention can attain good fixation properties and anti-offset properties within a wider temperature range in uses where the development and fixation are conducted at a wide range of fixing speeds, particularly at high speeds, and is superior in resistance to abrasion and peeling of the fixed image. Furthermore, sufficient mechanical strength is present at the same time, so that there is resistance to abrasion with the carrier inside the developing apparatus, and it is thus possible to conduct printing of images with high density and high definition, which are free from fogging without leaving spent carrier or scattering of toner.

DETAILED DESCRIPTION OF THE INVENTION

Figure 1:
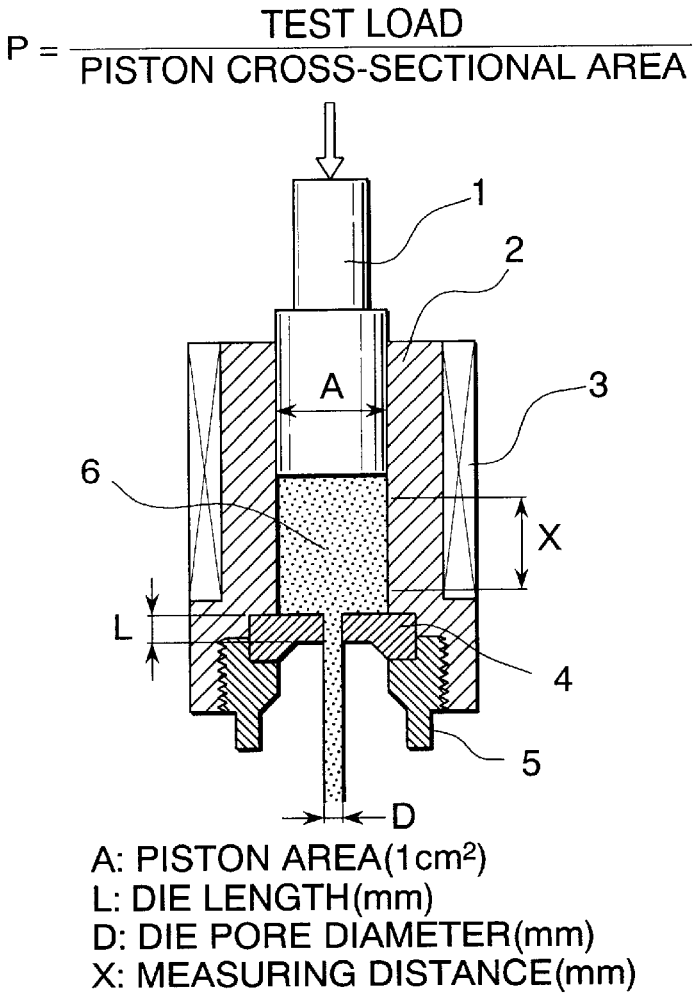
FIG. 1 is a schematic view showing a structure of the cylinder portion of the constant load extrusion type capillary rheometer.
Figure 2:
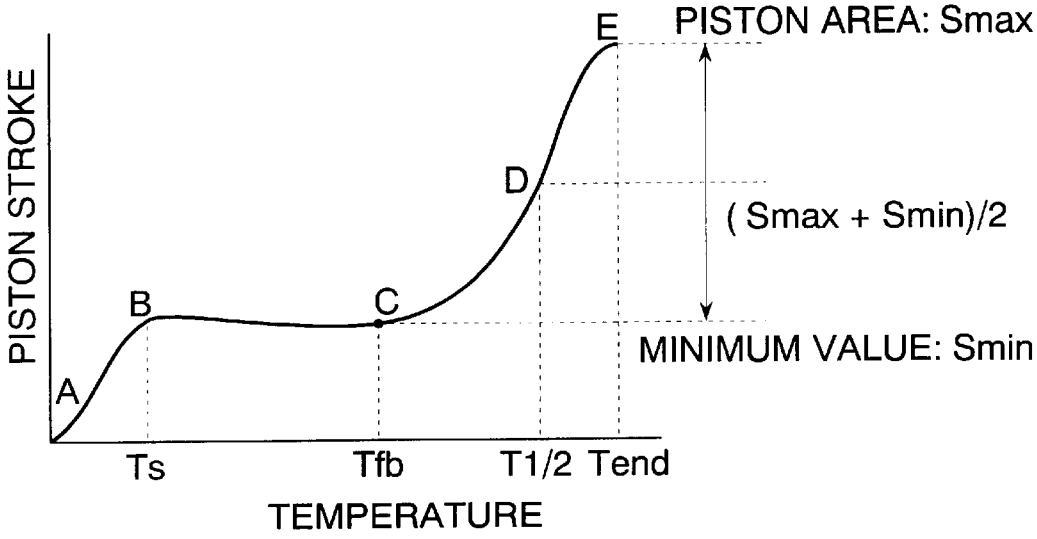
FIG. 2 is a graph showing an example of the flowing curve by the temperature elevating method.

When the softening temperature Ts and the flow beginning temperature Tfb are too high, fixation properties at low temperatures become inferior and cold offset is liable to occur. On the other hand, when they are too low, storage stability is lowered and hot offset is liable to occur.

Accordingly, the softening temperature Ts of the toner for electrostatic image development is preferably within a range of 60–80° C., and more preferably within a range of 60–75° C., while the flow beginning temperature Tfb is preferably within a range of 70–105° C. and more preferably within a range of 85–100° C.

When any of the melting point T½ by the ½-process and the flow ending temperature Tend is too high, pulverizability becomes inferior, thereby lowering productivity. Therefore, the melting point T½ by the ½-process is preferably within a range of 110–140° C. and more preferably within a range of 120–140° C., while the flow ending temperature Tend is preferably within a range of 120–144° C. and more preferably within a range of 125–144° C.

Ts, Tfb, T½ and Tend defined in the present invention employing the constant load extrusion type capillary rheometer are values obtained by measurement under the following conditions.

Measurement Conditions for a Constant Load Extrusion Type Capillary Rheometer
Piston cross-sectional area: 1 $cm^2$
Cylinder pressure: 0.98 MPa
Die length: 1 mm, Die pore diameter: 1 mm
Measuring initiation temperature: 50° C.
Temperature elevating speed: 6° C./min
Sample weight: 1.5 g As a matter of course, the values of Ts, Tfb, T½ and Tend defined in the present invention vary depending on the measuring conditions. It is apparent from the present inventors' study that, when only the temperature elevating speed is controlled to 10° C./min among the above measuring conditions as set in Japanese Patent Application, First Publication No. Hei 11-190913 described in the "BACKGROUND OF THE INVENTION", each of values of Ts, Tfb, T½ and Tend increases by 5–8° C. or higher as compared to the value measured at 6° C./min.

The molecular structure and composition of the binder resin in the toner for electrostatic image development are not specifically limited as long as the binder resin exhibits the above melting characteristics for substances to be incorporated into the toner. For example, resins obtained by dehydration condensation of dicarboxylic acid and diol described below using conventional methods can be used.

(1) Dicarboxylic Acids

Dicarboxylic acids include, for example, phthalic anhydride, terephthalic acid, isophthalic acid, orthophthalic acid, adipic acid, maleic acid, maleic anhydride, fumaric acid, itaconic acid, citraconic acid, hexahydrophthalic anhydride, tetrahydrophthalic anhydride, cyclohexane dicarboxylic acid, succinic acid, malonic acid, glutaric acid, azelaic acid, sebacic acid, and the like, as well as derivatives or ester products thereof.

(2) Diols

Diols include, for example, ethylene glycol, diethylene glycol, triethylene glycol, propylene glycol, dipropylene glycol, tripropylene glycol, butane diol, pentane diol, hexane diol, cyclohexane dimethanol, bisphenol A, polyoxyethylene-(2.0)-2,2-bis(4-hydroxyphenyl) propane and derivatives thereof, polyoxypropylene-(2.0)-2,2-bis(4-hydroxyphenyl) propane, polyoxypropylene-(2.2)-polyoxyethylene-(2.0)-2,2-bis(4-hydroxyphenyl) propane, polyoxypropylene-(6)-2,2-bis(4-hydroxyphenyl) propane, polyoxypropylene-(2.2)-2,2-bis (4-hydroxyphenyl) propane, polyoxypropylene-(2.4)-2,2-bis(4-hydroxyphenyl) propane, polyoxypropylene-(3.3)-2,2-bis(4-hydroxyphenyl) propane and derivatives thereof, polyethylene glycol, polypropylene glycol, ethylene oxide-propylene oxide random copolymer diol, ethylene oxide-propylene oxide block copolymer diol, ethylene oxide-tetrahydrofuran copolymer diol, polycaprolactone diol, and the like.

(3) Polyvalent Monomers Having Three or More Valances

If necessary, there can be employed polyvalent carboxylic acids having three or more functional groups such as trimellitic acid, trimellitic anhydride, pyromellitic acid, pyromellitic anhydride, and the like, as well as derivatives or ester products thereof; polyvalent alcohols having three or more functional groups such as sorbitol, 1,2,3,6-hexane tetraol, 1,4-sorbitan, pentaerythritol, 1,2,4-butane triol, 1,2,5-pentane triol, glycerin, 2-methyl propane triol, 2-methyl-1, 2,4-butane triol, trimethylol ethane, trimethylol propane, 1,3,5-trimethylol benzene, and the like; epoxy compound having five or more valences such as cresol novolak type epoxy resin, phenol novolak type epoxy resin, polymer or copolymer of vinyl compound having an epoxy group, epoxylated resorcinol-acetone condensate, partially epoxylated polybutadiene, and the like; epoxy compounds having two to four valances such as bisphenol A epoxy resin, bisphenol F epoxy resin, bisphenol S epoxy resin, glycerin triflycidyl ether, trimethylolpropane triglycidyl ether, trimethylolethane triglycidyl ether, pentaerythritol tetraglycidyl ether, and the like, together with the dicarboxylic acids and diols described above.

The polyester resin in the present invention may be obtained by conducting a dehydration condensation reaction or an ester exchange reaction employing the raw material components described above in the presence of a catalyst. The reaction temperature and reaction period are not particularly restricted; however, these are normally within a range of 150–300° C. and 2–24 hours.

Examples of the catalyst which may be employed when conducting the reaction described above include, for example, zinc oxide, tin (I) oxide, tetrabutyl titanate, monobutyltin oxide, dibutyl tin oxide, dibutyl tin dilaurate, p-toluene sulfonic acid, and the like.

The molecular weight of the binder resin in the present invention is not specifically limited as long as it can meet the melting characteristics of the toner defined in the present invention employing the compounds and method described hereinabove. Particularly preferable embodiments include the following.

That is, in the most preferable embodiment for the binder resin of the toner for electrostatic image development of the present invention, a mixture of a first polyester resin (A) having a straight-chain or crosslinked structure (hereinafter referred to as "resin (A)") and a second polyester resin (B) having a crosslinked structure (hereinafter referred to as "resin (B)") is used, whereby the functions of the binder resin are shared between resins (A) and (B), so that the toner for electric static image development of the present invention can exhibit sufficient properties for toner for high-speed machine.

The method described above in general allots the anti-offset properties at low temperature and fixation properties at low temperature to the resin (A) and in general allots the anti-offset properties at low temperatures and toughness to the resin (B).

If the resins (A) and (B) have the properties described above, a THF-insoluble fraction may be present in the structure. As used herein, the term "THF-insoluble fraction" refers to a residue on specialized filter paper, which is obtained by placing 1 g of the synthesized resin powder on the filter paper and heating with reflux in THF as a solvent for eight hours employing a Soxhlet's reflux condenser. As used herein, the term "crosslinked structure" includes both of a branched structure wherein a polyester backbone chain is branched and a structure wherein a polyester backbone chain is bonded in the form of a network. In the polyester having the branched structure, the content of the THF-insoluble fraction defined in the present invention is usually 0%, but the larger the size of the network structure, the higher the content of the THF-insoluble fraction.

The straight-chain polyester resin employed in the resin (A) can be obtained by dehydration condensation of the dicarboxylic acids (1) and diols (2) described above. The resin (A) or (B) having a branched or crosslinked structure can be obtained by additionally employing a polyvalent monomer (3) having three or more valances.

Considering the respective temperature characteristics according to the constant load extrusion type capillary rheometer from the above point of view, the softening temperature Ts (A), flow beginning temperature Tfb (A) and melting temperature T½ (A) by the ½-process of the resin (A) as well as the softening temperature Ts (B), flow beginning temperature Tfb (B) and melting temperature T½ (B) by the ½-process of the resin (A) are particularly important.

Concretely, the softening temperature Ts (A) of the resin (A) is preferably within a range of 50–80° C. and more preferably within a range of 60–75° C.

When the difference between the softening temperature Ts (A) and flow beginning temperature Tfb (A) is small, the pulverizability becomes inferior because of high crystallizability, and a difference in crystallizability occurs as a result of heat history during the cooling, thus exerting an influence on the melting characteristics of the toner. On the other hand, when the difference is large, the fixation properties at low temperatures become inferior because of poor sharp melting properties. Therefore, the difference is preferably within a range of 5–20° C.

The melting temperature Tfb (A) by the ½-process is preferably within a range of 70–130° C. and more preferably within a range of 80–120° C.

For the reasons described above, the flow ending temperature Tend (A) of the resin (A) is not specifically limited because the Tend (B) of the resin (B) exerts a large influence on the toner characteristics, and the Tend (A) is preferably within a range of 80–140° C. and more preferably within a range of 90–130° C. considering the mixed system of the two.

Since the resin defined by these properties has a low softening temperature and a high crystallizability, it is sufficiently molten and exhibits excellent anti-offset properties at low temperatures and excellent fixation strength even if the heat energy is reduced by reduction of the temperature of the heat roller or increase of the processing speed.

With respect to the softening temperature Ts, Ts (A) of the resin (A) exerts a large influence on the toner characteristics so that Ts (B) of the resin (B) is not specifically limited. Considering a mixed system of the two, the softening temperature Ts is preferably within a range of 60 to 100° C., and more preferably within a range of 70–90° C.

When a difference between the softening temperature Ts (B) and flow beginning temperature Tfb (B) is too small, the viscosity of the toner molten during the fixation process is lowered and the internal cohesive force of the molten layer is also lowered quickly, thus hot offset is liable to occur. Therefore, the difference is preferably 30° C. or higher, and more preferably 40° C. or higher.

Furthermore, when both the melting temperature Tfb (B) by the ½-process of the resin (B) and flow ending temperature Tend (B) are too low, hot offset is liable to occur. On the other hand, when the two are too high, pulverizability becomes inferior thereby lowering productivity. Therefore, Tfb (B) is preferably within a range of 130–210° C. and more preferably within a range of 140–200° C. The flow ending temperature Tend (B) is preferably within a range of 140–220° C. and more preferably within a range of 150–210° C.

Since the resin defined by these properties has strong rubber elasticity and high melt viscosity, the internal cohesive force of the molten toner layer is maintained even during melting with heating in the fixation process and the occurrence of hot offset is low, and the resin exhibits excellent resistance to abrasion after fixation because of its toughness.

Referring to the glass transition temperature Tg of the resin, when Tg is too low, the resistance to high temperatures during storage and blocking are lowered. On the other hand, when Tg is too high, fixation properties at low temperature are effected. Therefore, the glass transition temperature of resin (A) and resin (B) employed in the present invention is preferably within a range of 45–75° C., and particularly preferably within a range of 50–75° C. even if the resin (A) and resin (B) are employed in combination or employed alone, respectively.

By combining resin (A) and resin (B) in appropriate proportions, a toner which fully satisfies the anti-offset properties and fixation properties within a wide temperature range can be provided.

When the weight ratio of the resin (A) to the resin (B), M (A)/M (B), is too small, the fixation properties are effected. On the other hand, when the weight ratio is too large, the anti-offset properties are effected. Therefore, the weight ratio is preferably within a range of 1/9 to 9/1, more preferably within a range of 2/8 to 8/1, and most preferably within a range of 3/7 to 7/3.

When the melting temperature according to the ½-process of resin (A) and that of resin (B) are T½ (A) and T½ (B), respectively, the following expression: T½ (A)<T½ (B) may be established. T½ (A)−½ (B) is preferably within a range of 20–120° C. and more preferably within a range of 30–110° C. in order to impart both fixation properties at low temperatures and anti-offset properties, so that mixing during the melt-kneading is uniform, and problems due to differences in viscosity between the resins do not occur.

With respect to the molecular weight of the THF-soluble fraction of the resin (A), the weight-average molecular weight (Mw) is preferably within a range of 3000–500000, and more preferably within a range of 4000–30000. Mw/Mn is preferably 8 or less, and more preferably 4 or less. When Mw is 3000 or less, the toner is liable to cause an aggregation phenomenon, resulting in problems during storage and printing. On the other hand, when Mw exceeds 50000, the fixation properties become inferior. With respect to the resin (B), Mw of the THF-soluble fraction is preferably within a range of 60000 to 400000, while Mw/Mn is preferably 10 or more. When Mw is 60000 or less, the toner is liable to cause an offset phenomenon during the fixation. On the other hand, when Mw exceeds 400000, the fixation properties become inferior.

For the resin (A) and resin (B), the acid number is preferably 20 or less, and particularly preferably 10 or less, so as not to cause a reduction in the charge amount as a result of enhancement of the moisture absorption properties in view of storage stability and developing properties Conventional colorants may be employed in the present invention. Examples of black colorants include carbon blacks which are differentiated based on their method of preparation, such as furnace black, channel black, acetylene black, thermal black, lamp black, and the like; examples of blue colorants include the phthalocyanine C.I. Pigment Blue 15-3, and the indanthrone C.I. Pigment Blue 60 and the like; examples of red colorants include the quinacridone C.I. Pigment Red 122, the azo C.I. Pigment Red 22, C.I. Pigment Red 48:1, C.I. Pigment Red 48:3, C.I. Pigment Red 57:1, and the like; yellow colorants include the azo C.I. Pigment Yellow 12, C.I. Pigment Yellow 13, C.I. Pigment Yellow 14, C.I. Pigment Yellow 17, C.I. Pigment Yellow 97, C.I. Pigment Yellow 155, the isoindolinone C.I. Pigment Yellow 110, the benzimidazolone C.I. Pigment Yellow 151, C.I. Pigment Yellow 154, C.I. Pigment Yellow 180, and the like. The amount of the colorant contained is within a range of 1 part by weight to 20 parts by weight. One type of such colorant may be employed, or two or more may be employed in combination.

When employing carbon black particularly, carbon black whose polycyclic aromatic hydrocarbon content is 15 ppm or less is preferably employed. More preferably, it is carbon black whose polycyclic aromatic hydrocarbon content is 12 ppm or less. Examples of the carbon black include Regal 330, Regal 330R, Vulcan XC-72, Vulcan Xc-72R, Black Pearls L. Black Pearls 1300 and Mogul L (produced by Cabot Specialty Chemicals Inc.); Raven 5750, Raven 5250, Raven 3500 and Raven 780 (manufactured by Colombia Carbon); and Mitsubishi #0025 and Mitsubishi #44 (produced by Mitsubishi Chemicals Co., Ltd.). Examples of the polycyclic aromatic hydrocarbon include benzpyrene, anthracene benzopyrene, phenanthrene, pyrene, and the like., which are carcinogens. When employing carbon black containing 15 ppm or more of these compounds as the colorant for toner, the charge amount is lowered and contamination at the non-image portion and scattering of toner are liable to occur.

The releasing agent employed in the electrostatic image development includes, for example, known polypropylene wax, polyethylene wax, modified polyolefin wax, higher fatty acid ester, Fischer-Tropsch wax, graft-polymerized wax, higher aliphatic alcohol, amide wax, natural wax, and the like. Among these waxes, a releasing agent containing as a chief component wax which contains as a chief component a higher fatty acid ester compound and/or an aliphatic alcohol compound and/or a Fischer-Tropsch wax is preferable because of good dispersibility, good releasability and good slidability. When adding these waxes to the toner, there can be obtained good anti-offset properties and fixation strength as compared with the same amount of polyolefin wax such as polypropylene wax, polyethylene wax, or the like.

Furthermore, not only do these waxes serve as a releasing agent for preventing the offset phenomenon during the heat roller fixation, but also the waxes are not deposited on the surface of the carrier during the printing of large numbers of pages for a long period of time thereby stably charging the toner, thus making it possible to print a high-definition and fine image without causing scattering of toner.

The wax containing as a chief component a higher fatty acid ester compound and/or an aliphatic alcohol compound includes, for example, carnauba wax, montan ester wax, rice wax, wax from scale insects, lanolin wax, and compounds represented by the following general formulas 4 to 8.

General formula 4

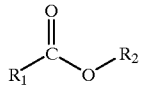

($R_1$ and $R_2$ represent a hydrocarbon group having a number of carbons within a range of 1–40, at least one of which represents a chain hydrocarbon group having a number of carbons of 12 or more)

General formula 5

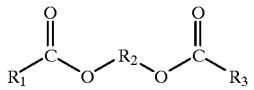

($R_1$, $R_2$ and $R_3$ represent a hydrocarbon group having a number of carbons within a range of 1–40, at least one of which represents a chain hydrocarbon group having a number of carbons of 12 or more)

General formula 6

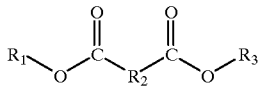

($R_1$, $R_2$ and $R_3$ represent a hydrocarbon group having a number of carbons within a range of 1–40, at least one of which represents a chain hydrocarbon group having a number of carbons of 12 or more)

General formula 7

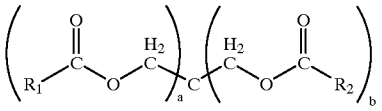

($R_1$ represents a hydrocarbon group having a number of carbons within a range of 12–40, $R_2$ represents a hydrocarbon group having a number of carbons within a range of 1–40, and a+b is 4, provided that a represents an integer within a range of 1–4 and b represents an integer within a range of 0–3)

General formula 8

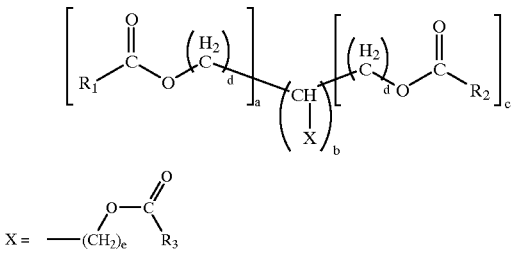

($R_1$, $R_2$ and $R_3$ represent a hydrocarbon group having a number of carbons within a range of 1–40, at least one of which represents a chain hydrocarbon group having a number of carbons of 12 or more, a and c represent an integer within a range of 0–2 and a+c is 2, b represents an integer within a range of 1 to 4, d is 1 or 2, and e is d−1)

Specific examples of the waxes represented by the general formulas described above include the following compounds.

Wax 1: Specific Example of the General Formula 4

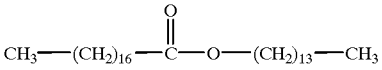

Wax 2: Specific Example of the General Formula 5

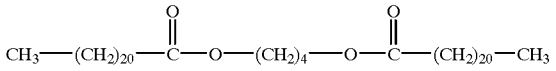

Wax 3: Specific Example of the General Formula 6

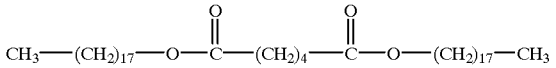

Wax 4: Specific Example of the General Formula 7

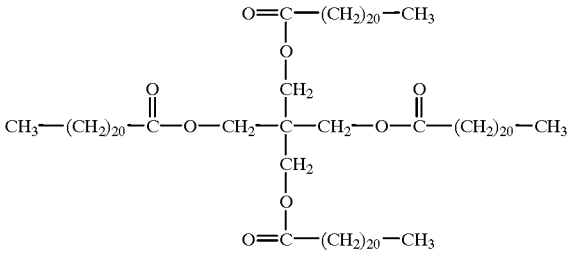

Wax 5: Specific Example of the General Formula 8

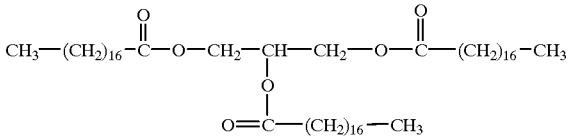

Wax 6: Specific Example of the General Formula 8

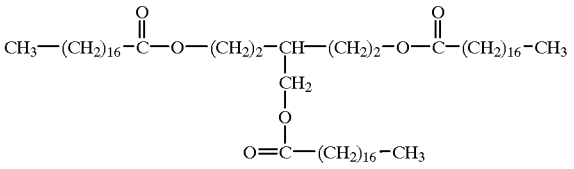

It is preferable that the carnauba wax which is employed be carnauba wax from which free aliphatic acids have been removed by refining. It is preferable that the acid number of this carnauba wax from which free aliphatic acids have been removed be eight or less, and more preferably the acid number is five or less. The carnauba wax from which free aliphatic acids have been removed more readily forms microcrystals than conventional carnauba wax, and this increases its dispersibility in the polyester resin. The montan ester wax is refined from minerals, and as a result of the refining, forms microcrystals in the same way as carnauba wax, thus increasing its dispersibility in the polyester resin.

It is preferable that the acid number of this montan ester wax be 30 or less. Furthermore, the rice wax is refined from rice husk wax, and the acid number thereof is preferably 13 or less.

The scale insect wax may be obtained by dissolving the wax from components secreted by young scale insects (also termed Chinese wax insects) in, for example, hot water, and removing the supernatant and then cooling and solidifying, or by repeating this process. The scale insect wax refined in this manner is white in color when in a solid state, exhibits an extremely sharp melting point, and may be used as the wax for the toner in the present invention. When refined, the acid number thereof is 10 or less, and a value of 5 or less is preferable for use as the toner.

The lanolin wax is obtained by purifying and hydrating a waxy substance deposited on the wool, and preferably has an acid number of 8 or less, and more preferably 5 or less.

The releasing agent which contains an aliphatic alcohol compound as a chief component includes, for example, those containing as a chief component a higher alcohol obtained by the oxidation reaction of paraffin, olefin, or the like.

The releasing agent which contains an aliphatic alcohol as a chief component includes, for example, "UNILIN 425" and "UNILIN 550" (produced by Petrolite Corporation); "NPS-9210" and "PARACOL 5070" (produced by Nippon Seiro Co., Ltd.).

Sasol wax (produced by Sasol Chem. Ltd.) is suitable as the Fischer-Tropsch wax.

Sasol wax is a hard crystalline wax and has the advantage of low viscosity regardless of its melting point, examples thereof include Sasol wax H1, H2, H8, C1, C2, C3, C4 and C2N3; fine particle type waxes such as H1-N6, SPRAY 30, SPRAY 40, and the like; oxidation type waxes such as A1, A2, A3, A6, A7, A14, and the like. Among these waxes, C series waxes such as Sasol wax C1, C2, C3, C4, C2N3, and the like are best suited in the present invention.

Among the above specific examples, carnauba wax having an acid number of 8 or less, wax from scale insects, and wax 4 as tetrabehenyl ester of pentaerythritol are most preferable waxes.

As the wax of the present invention, those having a melting point within a range of 65–130° C. are particularly preferable because of the significant contribution to the anti-offset properties.

These releasing agents may be employed alone or in combination and good fixation offset properties can be obtained by their inclusion in an amount within a range of 0.3–15 parts by weight, and preferably within a range of 1–5 parts by weight, based on the binder resin. When the amount is smaller than 0.3 parts by weight, the anti-offset properties are impaired. On the other hand, when the amount is larger than 15 parts by weight, the fluidity of the toner becomes inferior and, furthermore, spent carrier is left as a result of deposition of the toner on the surface of the carrier, thereby exerting an adverse influence on the charge characteristics of the toner.

Furthermore, synthetic waxes such as polyamide wax, graft-polymerized wax, modified polyolefin wax, polypropylene wax, polyethylene wax, and the like can be employed in combination with the waxes in the present invention.

In the present invention, an optional charge control agent can be employed, if necessary.

The positive charge control agents employed in the present invention is not specifically limited as long as they are compounds capable of providing the toner with positive charging properties, but are preferably triphenyl methane dyes, nigrosine dyes, quaternary ammonium salts, and resins containing quaternary ammonium groups and/or amino groups. These compounds may be employed alone or in combination with two or more charge control agents. The positive charge control agents include, but are not limited to, the following.

The triphenyl methane dye includes, for example, "OIL BLUE" (produced by Orient Chemical), and "Copy Blue PR" (produced by Clariant Japan).

The nigrosine dye includes, for example, "NIGROSINE BASE EX", "OIL BLACK BS", "BONTORON N-01", "BONTORON N-04", "BONTORON N-07" and "BONTORON N-21" (produced by Orient Chemical).

The quaternary ammonium salt includes, for example, "BONTORON P-51" (produced by Orient Chemical), and "TP-302", "TP-415" and "TP-610" (produced by Hodogaya Chemical Industries Co., Ltd.).

The resin containing a quaternary ammonium group and/or an amino group includes, for example, "FCA-201-PS" (produced by Fujikura Chemicals Co., Ltd.).

The quaternary ammonium salt compound is particularly preferably at least one selected from the compounds represented by the following general formulas 1, 2 and 3. The compound represented by the general formula 1 includes BONTORON P-51 (produced by Orient Chemical), while the compound represented by the general formula 2 includes TP-302, TP-610 and TP-415 (produced by Hodogaya Chemical Industries Co., Ltd.).

General formula 1

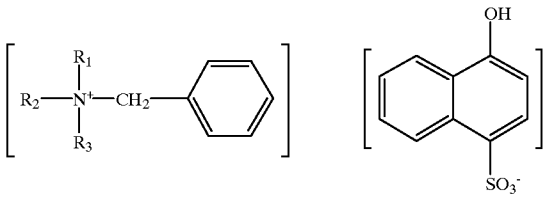

(In the formula, $R_1$ to $R_3$ indicate $C_nH_{2n+1}$ groups, wherein n is an integer within a range of 1 to 10, and $R_1$ to $R_3$ may differ).

General formula 2

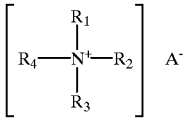

(In the formula, $R_1$, $R_2$, $R_3$, and $R_4$ represent, respectively and independently, a hydrogen atom, an alkyl group or alkenyl group having a number of carbons within a range of 1 to 22, an unsubstituted or substituted aromatic group having a number of carbons within a range of 1 to 20, and an aralkyl group having a number of carbons within a range of 7 to 20; $A^-$ indicates a molybdic acid anion or a tungstic acid anion, or a heteropolyacid anion containing molybdenum or tungsten atoms.)

General formula 3

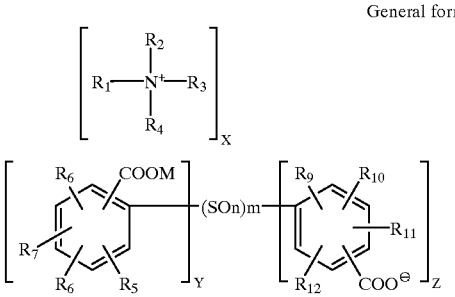

(In the formula, m represents 1, 2 or 3; n represents 0, 1 or 2; M represents a hydrogen atom or a monovalent metal ion, X and Z represent 1 or 2;

and Y represents 0 or 1; Y is 1 and Z is 1 when X is 1; and Y is 0 and Z is 2 when X is 2; $R_5$–$R_{12}$ represent hydrogen, a straight-chain or branched, saturated or unsaturated alkyl group having a number of carbons within a range of 1–30, an alkoxylene group having a number of carbons within a range of 1 to 4 or a polyalkyloxylene group represented by the general formula (—$C_{2-5}$ alkylene-O)n-R (provided that R is hydrogen or an alkyl or acyl group having a number of carbons within a range of 1–4, and n is an integer within a range of 1–10) ; $R_1$, $R_2$, $R_3$ and $R_4$ represent hydrogen, a straight-chain or branched, saturated or unsaturated alkyl group having a number of carbons within a range of 1–30, an oxyethyl group represented by the general formula (—$CH_2$—$CH_2$—O)n-R (provided that R is hydrogen or an alkyl or acyl group having a number of carbons within a range of 1–4, and n is an integer within a range of 1–10), or a mononuclear or polynuclear alicyclic residue, mononuclear or polynuclear aromatic residue or mononuclear or polynuclear aliphatic residue having a number of carbons within a range of 5–12.)

More concretely, the quaternary ammonium salt compound includes the following compounds.

(1-1)

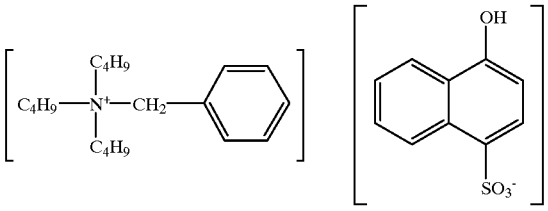

(2-1)

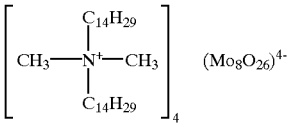

(2-2)

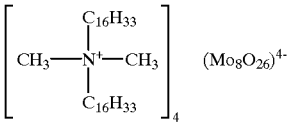

(2-3)

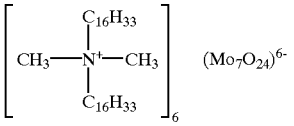

(2-4)

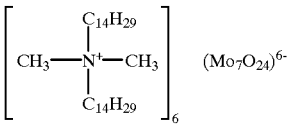

-continued (2-5)

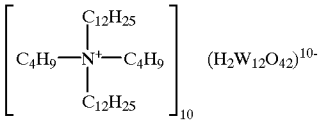

(2-6)

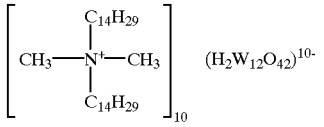

(2-7)

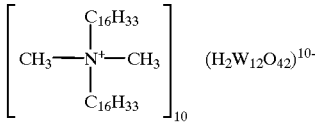

(2-8)

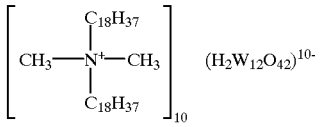

(2-9)

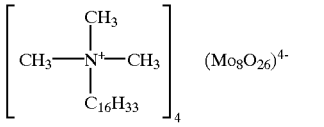

(2-10)

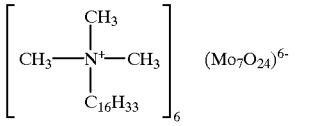

(2-11)

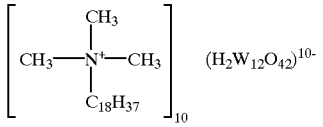

(3-1)

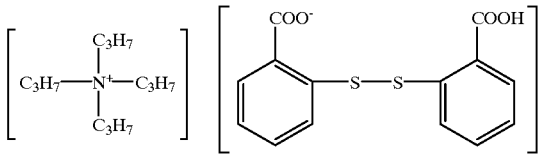

(3-2)

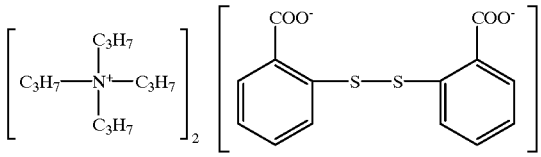

Two or more charge control agents described above may be employed in combination. When employing the nigrosine dye in combination with the quaternary ammonium salt compound, the ratio thereof is preferably within a range of 1/9–9/1, and more preferably within a range of 2/8–8/2.

The nigrosine has a strong ability to apply a positive charge, while the quaternary ammonium salt compound is superior in uniformity and stability of the charge. By employing both together, it is possible to stably obtain a clear printed image which does not exhibit fogging during continuous printing.

The content of the volatile amine which remains in the toner of the present invention is preferably 150 ppm or less. The content of the volatile amine is ideally 0 ppm, but is usually within a range of 0–150 ppm, and is more preferably within a range of 0–100 ppm, in order to maximize the technical effects of the present invention. When the content is larger than 150 ppm, fogging (deposition of the toner onto the non-image portion) is liable to occur during continuous printing. In view of problems such as toxicity, odor, and the like, it has become necessary to control or manage the volatile chemical substance generated during the use of the copying machine and printer. In light of environmental considerations, the content of the volatile amine which remains in the toner of the present invention is preferably 150 ppm or less.

There are many causes for the generation of the volatile amine component, and a source for generation is the positive charge control agent which intrinsically contains the volatile amine or has a quaternary ammonium salt structure capable of generating the volatile amine by thermal decomposition. Accordingly, use of a positive charge control agent containing a small amount of the volatile amine component or having a quaternary ammonium salt structure capable of generating no volatile amine by thermal decomposition, or a forced deaeration treatment described below are effective as a means for controlling the content of the volatile amine remaining in the toner to within the range described above.

One example of the forced deaeration treatment includes removal of the volatile amine component during the melt-kneading of the toner. It is remarkably effective for reduction of the volatile amine component that a charge control agent is incorporated in a binder resin in a high concentration before the respective raw materials of the toner are mixed and melt-kneaded, and the mixture is subjected to a forced deaeration treatment during the pre-kneading of dispersing the mixture (step referred generally to as a masterbatch treatment).

In the present invention, of the compounds described above, the compounds (1-1), (2-1), (3-1) and (3-2) can be preferably employed as the quaternary ammonium salt compound. When employing the compound (1-1), the content must be reduced as much as possible by the above forced deaeration treatment because tributylamine is liable to be generated by the thermal decomposition.

In the present invention, a nigrosine charge control agent can be employed preferably. In that case, preferable nigrosine charge control agents are those which contain a smaller amount of the volatile amine or do not contain the same component. The volatile amine in the nigrosine charge control agent includes aniline. As the method of reducing aniline when aniline is present, a forced deaeration treatment is effective, similar to the method of reducing the content of the volatile amine in the quaternary ammonium salt compound. The content of aniline in the toner of the present invention is preferably 10 ppm or less. When the content is larger than 10 ppm, odor occurs and, furthermore, fogging and scattering of toner are liable to occur.

Furthermore, it has already described that the quaternary ammonium salt, which can be employed preferably in the present invention, includes the compound (2-1). When employing the compound, the content of the compound in the toner is preferably 5000 mg/kg or less, and more preferably 3500 mg/kg or less, in terms of an equivalent amount of molybdenum atoms. When the content is 5000 mg/kg or more, fogging and scattering of toner are liable to occur. In view of the fact that molybdenum is a heavy metal, it is not preferred that a large amount of the compound be contained in the toner.

The negative charge control agent employed in the present invention is not specifically limited as long as it is a compound capable of giving a negative charge to the toner, and is preferably an azo metal complex (salt), a salicylic acid metal complex (salt), a benzylic acid metal complex (salt), a tetraphenyl metal complex (salt), a phenol condensate of the calixarene type, a cyclic polysaccharides, or a resin charge control agent.

The amine metal complex (salt) includes, for example, "BONTORON S-34" and "BONTORON S-44" (produced by Orient Chemical).

The salicylic acid metal complex (salt) includes, for example, "BONTORON E-81", "BONTORON E-84" and "BONTORON E-88" (produced by Orient Chemical).

The benzylic acid metal complex (salt) includes, for example, "LR-147" and "LR-297" (produced by Japan Carlit Co., Ltd.).

The tetraphenyl metal salt includes, for example, "COPY CHARGE NX" (produced by Clariant Japan).

The calixarene type compound includes, for example, "BONTORON E-89" and "BONTORON F-21" (produced by Orient Chemical).

The cyclic polysaccharide includes, for example, "COPY CHARGE NCA" (produced by Clariant Japan).

The resin charge control agent includes, for example, "FCA-1001-NS" (produced by Fujikura Chemicals Co., Ltd.) and "COPY LEVEL NCS" (produced by Clariant Japan).

"TN-105" produced by Hodogaya Chemical Industries Co., Ltd. can also be employed preferably as a colorless negative charge control agent, although its structure is not clear.

The content of the charge control agent is preferably within a range of 0.3–10 parts by weight, and more preferably within a range of 1–5 parts by weight, based on 100 parts by weight of the binder resin.

The toner for electrostatic image development in the present invention contains as an essential component binder resins made of the polyester resin described above, colorants, releasing agents and charge control agents, and may contain other additives.

For example, metallic soaps, zinc stearate, or the like may be employed as the lubricant, and cerium oxide, silicon carbide, or the like may be employed as an abrasive.

Furthermore, in the case in which a portion or all of the colorant is replaced by a magnetic powder, it is possible to employ this as a magnetic single component developing toner. Examples of the magnetic powder include ferromagnetic metals such as iron, cobalt, nickel, or the like, or powders of alloys or compounds of magnetite, hematite, ferrite, and the like. Powders are also preferably employed in which such a magnetic powder is subjected, where necessary, to a hydrophobic treatment with organic silicon or titanium compounds or the like. The amount of magnetic powder included is preferably within a range of 15 to 70 weight percent with respect to the toner weight.

The toner of the present invention may be obtained by extremely common manufacturing methods, and does not require special manufacturing methods; however, it is possible to obtain this toner by first melting and kneading the resin, the colorant, and the charge control agent at a temperature above the melting point of the resin (the softening point), and pulverizing and grading it.

Concretely, for example, the resin described above, the colorant, and the charge control agent as essential components are uniformly mixed in advance using a Henschel mixer before melt-kneading. The conditions of the mixing are not specifically limited, but the mixing may be carried out in several portions to attain the desired uniformity. A flushing procedure may be carried out in advance so that the colorant and/or charge control agent are uniformly dispersed in the resin, or alternatively, they may be mixed and kneaded at high concentrations with the resin in a master batch.

The above mixture is kneaded by means of a kneading process employing two rollers, three rollers, a pressure kneader, or a twin-screw extruder or the like. At this time, it is sufficient if the colorant and the like are uniformly dispersed in the resin, so that the melting and kneading conditions are not particularly restricted; however, these are commonly within a range of 80–180° C. and from 30 seconds to 2 hours. The kneaded mixture is usually cooled by means of a cooling belt, roller or the like, but the cooling conditions can be set to obtain the desired dispersion state because a dispersion state of the releasing agent varies depending on the cooling conditions.

If necessary, the kneaded mixture is crushed for the purpose of reducing the load during the pulverizing step and improving pulverizing efficiency. The apparatus employed for the crushing and conditions are not specifically limited, but the kneaded mixture is generally crushed to a size of 3 mm mesh or less using a Rotoplex, pulverizer, or the like.

Next, the crushed mixture is pulverized in a mechanical pulverizer such as a Turbo Mill, a Kryptron, or the like; or an air type pulverizer such as a volute type jet mill, a counter jet mill, a collision plate type jet mill, or the like, and separated by means of an air separator or the like. The apparatus for pulverization and separation as well as conditions thereof may be selected and set to obtain a desired particle size, particle size distribution and particle form.

The average particle diameter of the particles which form the base material of the toner is not particularly restricted; however, this is normally set within a range of 5–15 micrometers.

Commonly, the toner thus obtained is mixed with external additives employing a mixing machine such as, for example, a Henschel mixer.

In the present invention, various additives (referred to as external additives) can be employed to improve the surface of the toner base material, such as, for example, to increase the fluidity of the toner, and to improve the charge characteristics thereof, or the like. Possible materials employed include, for example, inorganic microparticles such as silicon dioxide, titanium oxide, alumina, and the like, as well as the products resulting when these are subjected to surface treatment employing a hydrophobic treating agent such as silicon oil, or the like.

Among these, silicon dioxide (silica), the surface of which has been subjected to hydrophobic treatment by means of various polyorganosiloxanes or silane coupling agents, is particularly advantageously employed.

Such a product is commercially available under, for example, the following trade names.

AEROSIL; R972, R974, R202, R805, R812, RX200, RY200, R809, RX50, RA200HS, RA200H (Nippon Aerosil)

WACKER; HDK K2000, H2050EP, HDK H3050EP, HVK2150 (Wacker Chemicals East Asia)

NIPSIL; SS-10, SS-15, SS-20, SS-50, SS-60, SS-100, SS-50B, SS-50F, SS-10F, SS-40, SS-70, SS-72F (Nippon Silica Industries)

CABOSIL; Ts-500, Ts-530, TS-610, TS-720, TG-308F, TG-709F, TG-810G, TG-811F and TG820F (Cabot Specialty Chemicals Inc.)

The titanium oxide may be hydrophilic titanium oxide or hydrophobic titanium oxide prepared by surface-treating with octyl silane. Such a product is commercially available under, for example, the following trade names.

These are titanium oxide T805 (produced by Degsa) and titanium oxide P25 (produced by Nippon Aerosil)

The alumina includes aluminum oxide (produced by Degsa).

Among these, a hydrophobic silica having a bulk density of 100 g/l or less and a BET surface area within a range of 100–250 $m^2/g$ is preferably employed and a hydrophobic silica having a bulk density of 80 g/l or less and a BET surface area within a range of 120–230 $m^2/g$ is employed more preferably. Furthermore, a hydrophobic silica whose surface was treated with hexamethyldisilazane, aminosilane and/or cyclic silazane is most preferred.

The hydrophobic silica having a bulk density of 100 g/l or less and a BET surface area of 100 $m^2/g$ or less does not exhibit good fluidity during high-speed printing when employed as the desired toner for a two component developer in the present invention, particularly when printing at high speeds which exceeds 20 or 30 m/min. Therefore, the hydrophobic toner is not quickly mixed with the carrier during the replenishment of the toner, thereby making it impossible to reach the predetermined charge amount, thus fogging and scattering of toner occur. As a result, an unclear printed image with a blurred printed image peripheral portion is formed.

To prevent this phenomenon, a large amount of silica must be added externally, thereby making it possible to improve the fluidity to obtain an image with high definition and high image quality during high-speed printing. By externally adding a large amount of silica, however, the silica is liable to be deposited on a photosensitive medium. In the worst case, the silica deposited on the photosensitive material agglomerates in the form of a film to cause image defects.

By coating the toner surface as a result of the deposition of a large amount of silica onto the toner surface, the toner particles do not readily fuse to each other during the heat roller fixation, and problems such as poor fixation do not occur.

In the present invention, the toner can be provided with sufficient fluidity by the addition of a small amount of the hydrophobic silica having a bulk density of 100 g/l and a BET surface area within a range of 100–250 $m^2/g$. Accordingly, filming on the photosensitive medium does not occur and the fixation properties are not impaired.

As is apparent from the descriptions described above, according to the present invention, by employing a hydrophobic silica having the physical properties described above, the resulting toner retains sufficient fluidity even during high-speed printing and can be quickly charged even after replenishment of the toner, thus making it possible to obtain a printed image with high definition and high image quality without causing fogging and scattering of toner.

The characteristics described above are most remarkably exhibited when hydrophobic silica is employed with hexamethyldisilazane, aminosilane and/or cyclic silazane as a surface treating agent. Such a hydrophobic silica includes RA-200HS (produced by Nippon Aerosil) and TG-820F (produced by Cabot Specialty Chemicals Incorporated).

The particle diameter of the external additives is preferably one-third or less that of the diameter of the toner particles, and more preferably one-tenth that diameter or less. Furthermore, these external additives may be simultaneously employed in two types having differing average particle diameters. Furthermore, the proportion thereof which is employed is normally within a range of 0.05–5 percent by weight, and preferably within a range of 0.1–3 percent by weight, based on the toner.

When employing the toner for electrostatic image development of the present invention in the two component developing method, the following carrier can be employed.

The core agent of the carrier employed in the present invention may be an iron powder carrier which is commonly employed in the two component developing method, a magnetite carrier, or a ferrite carrier; among these, ferrite or magnetite carriers, which have a low true specific gravity, a high resistance, which have superior environmental stability, and which can be easily made spherical and thus have good flow characteristics, are preferably employed. The shape of the core agent may be spherical or unspecified. The average particle diameter is generally within a range of 10–500 microns; however, in printing images with high resolution, a range of 30–80 microns is preferable.

Furthermore, a coated carrier in which such a carrier is covered with resin may be employed, and examples of the coating resin include, for example, polyethylene, polypropylene, polystyrene, polyacrylonitrile, polyvinyl acetate, polyvinyl alcohol, polyvinyl butyral, polyvinyl chloride, polyvinyl carbazole, polyvinyl ether polyvinylketone, vinyl chloride-vinyl acetate copolymer, styrene/acrylic copolymer, straight silicon resin comprising organosiloxane bonds or derivatives thereof, fluorine resin, (meth) acrylate resin, polyester, polyurethane, polycarbonate, phenol resin, amino resin, melamine resin, benzoguanamine resin, urea resin, amide resin, epoxy resin and the like. Among these, silicon resin, fluorine resin, and (meth) acrylate resin have superior charge stability and coating strength and are preferably employed. In other words, in the present invention, it is preferable that the magnetic carrier be a resin coated magnetic carrier which contains ferrite or magnetite as a core agent and is coated with one or more resins selected from a group consisting of silicon resin, fluorine resin, and (meth) acrylate resin.

The toner for electrostatic image development of the present invention can be employed preferably in a high-speed apparatus capable of forming an image at a heat roller fixation speed of not less than 20 or 30 m/min, and simultaneously attain sufficient fixation properties at low temperatures and anti-offset properties even when employed in a high-speed apparatus whose heat roller fixation speed is not less than 45 m/min.

EXAMPLES

The following Examples and Comparative Examples further illustrate the present invention in detail. Hereinbelow, the numerical values within the composition descriptions indicate parts by weight.

The measurement employing the constant load extrusion type capillary rheometer was conducted under the conditions of a piston cross-sectional area of 1 $cm^2$, a cylinder pressure of 0.98 MPa, a die length of 1 mm, a die pore diameter of 1 mm, a measuring initiation temperature of 50° C., a temperature elevating speed of 6° C./min and a sample weight of 1.5 g.

First, an example of the synthesis of the binder resin which is employed in the preparation of the toner will be given.

The molecular weight of a THF-soluble component, which was obtained by dissolving each of polyester resins obtained in the respective Synthesis Examples in tetrahydrofuran (THF) and filtering, was measured.

Employing gel permeation chromatography (GPC) for analysis, the molecular weight was calculated by a calibration curve made using a standard polyethylene.

Synthesis of Straight-chain Polyester A-1

Terephthalic acid: 664 parts by weight

Ethylene glycol: 150 parts by weight

Polyoxyethylene-(2.2)-2,2-bis(4-hydroxyphenyl)propane: 632 parts by weight

The above materials were charged in a 2 liter four-necked flask equipped with a stirrer, a condenser and a thermometer and 4 parts by weight of tetrabutyl titanate was added under a nitrogen gas flow, and then the mixture was reacted at 240° C. under normal pressure for 15 hours while removing water produced by the dehydration condensation. Subsequently, depressurization was conducted and the reaction was continued under a pressure of 5 mmHg. The reaction was followed employing the softening point in accordance with the ASTM.E28-517 standard, and the reaction was completed when the softening point reached 85° C.

The resulting polyester had a Mw of 4500, Mw/Mn of 2.1 (where Mw represents a weight-average molecular weight and Mn represents a number-average molecular weight), Ts of 62° C., Tfb of 69° C., T½ of 83° C., Tend of 88° C., an acid number of 4, and Tg (determined by the DSC measuring method) of 47° C.

Synthesis of Straight-chain Polyester A-2

Terephthalic acid: 664 parts by weight

Polyoxypropylene-(2.2)-2,2-bis(4-hydroxyphenyl)propane: 688 parts by weight

Ethylene glycol: 150 parts by weight

In the same manner as in the case of the straight-chain polyester A-1, with the exception that the above materials were employed, synthesis was conducted to obtain a polyester resin having a Mw of 8600, Mw/Mn of 2.8, Ts of 73° C., Tfb of 83° C., T½ of 95° C., Tend of 102° C., an acid number of 9.8, and Tg of 59° C.

Synthesis of Straight-chain Polyester A-3

Terephthalic acid: 332 parts by weight

Isophthalic acid: 332 parts by weight

Polyoxypropylene-(2.2)-2,2-bis(4-hydroxyphenyl)propane: 460 parts by weight

Polyoxyethylene-(2.2)-2,2-bis(4-hydroxyphenyl)propane: 210 parts by weight

Ethylene glycol: 130 parts by weight

Glycerin: 30 parts by weight

In the same manner as in the case of the straight-chain polyester A-1, with the exception that the above materials were employed, synthesis was conducted to obtain a polyester resin having a Mw of 15000, Mw/Mn of 3.8, Ts of 79° C., Tfb of 95° C., T½ of 119° C., Tend of 129° C., an acid number of 3.5, and Tg of 65.0° C.

Synthesis of Crosslinked Polyester B-1

Terephthalic acid: 664 parts by weight

Ethylene glycol: 150 parts by weight

Neopentyl glycol: 166 parts by weight

Trimethylolpropane: 80 parts by weight

The above materials were charged in a 2 liter four-necked flask equipped with a stirrer, a condenser and a thermometer and 4 parts by weight of tetrabutyl titanate was added under a nitrogen gas flow, and then the mixture was reacted at 240° C. under normal pressure for 10 hours while removing water produced by the dehydration condensation. Subsequently, depressurization was conducted and the reaction was continued under a pressure of 5 mmHg. The reaction was followed employing the softening point in accordance with the ASTM.E28-517 standard, and the reaction was completed when the softening point reached 145° C. The resulting polyester had a THF-insoluble content of 0.3%, a molecular weight Mw (of THF-soluble fraction) of 155000, Mw/Mn of 30.3, Ts of 74° C., Tfb of 106° C., T½ of 141° C., Tend of 152° C., an acid number of 3.3, and Tg (determined by the DSC measuring method) of 61° C. The THF-insoluble content was determined by placing 1 g of the synthesized resin powder on specialized filter paper and heating under reflux in THF as a solvent for eight hours employing a Soxhlet's reflux condenser.

Synthesis of Crosslinked Polyester B-2

Terephthalic acid: 498 parts by weight

Isophthalic acid: 166 parts by weight

Polyoxypropylene-(2.2)-2,2-bis(4-hydroxyphenyl)propane: 550 parts by weight

Ethylene glycol: 150 parts by weight

Trimethylolpropane: 80 parts by weight

In the same manner as in the case of the crosslinked polyester B-1, with the exception that the above materials were employed, synthesis was conducted to obtain a polyester resin having a THF-insoluble content of 0.7%, a molecular weight Mw (of THF-soluble fraction) of 222000, Mw/Mn of 38.8, Ts of 83° C., Tfb of 117° C., T½ of 160° C., Tend of 175° C., an acid number of 4.9, and Tg (determined by the DSC measuring method) of 64° C.

Synthesis of Crosslinked Polyester B-3

Terephthalic acid: 332 parts by weight

Isophthalic acid: 266 parts by weight

Trimellitic acid: 115 parts by weight

Polyoxypropylene-(2.2)-2,2-bis(4-hydroxyphenyl)propane: 688 parts by weight

Ethylene glycol: 150 parts by weight

In the same manner as in the case of the crosslinked polyester B-1, with the exception that the above materials were employed, synthesis was conducted to obtain a polyester resin having a THF-insoluble content of 9.8%, a molecular weight (of THF-soluble fraction) of 114000, Mw/Mn of 40, Ts of 81° C., Tfb of 120° C., T½ of 165° C., Tend of 178° C., an acid number of 10.8, and Tg of 63° C.

Synthesis of Crosslinked Polyester B-4

Terephthalic acid: 332 parts by weight

Isophthalic acid: 232 parts by weight

Trimellitic acid: 154 parts by weight

Polyoxypropylene-(2.2)-2,2-bis(4-hydroxyphenyl)propane: 688 parts by weight

Ethylene glycol: 150 parts by weight

In the same manner as in the case of the crosslinked polyester B-1, with the exception that the above materials were employed, synthesis was conducted to obtain a polyester resin having a THF-insoluble content of 37%, a molecular weight Mw (of THF-soluble fraction) of 82500, Mw/Mn of 19.1, Ts of 87° C., Tfb of 138° C., T½ of 198° C., Tend of 217° C., an acid number of 14.1, and Tg (determined by the DSC measuring method) of 59° C.

Synthesis of Crosslinked Polyester B-5

Terephthalic acid: 332 parts by weight

Isophthalic acid: 332 parts by weight

Polyoxypropylene-(2.2)-2,2-bis(4-hydroxyphenyl)propane: 550 parts by weight

Ethylene glycol: 185 parts by weight

Trimethylolpropane: 65 parts by weight

In the same manner as in the case of the crosslinked polyester B-1, with the exception that the above materials were employed, synthesis was conducted to obtain a polyester resin having a THF-insoluble content of 0.3%, a molecular weight (of THF-soluble fraction) of 85900, Mw/Mn of 27.4, Ts of 70° C., Tfb of 101° C., T½ of 128° C., Tend of 136° C., an acid number of 6.4, and Tg (determined by the DSC measuring method) of 59.8° C.

Synthesis of Crosslinked Polyester B-6

Terephthalic acid: 664 parts by weight

Polyoxypropylene-(2.2)-2,2-bis(4-hydroxyphenyl)propane: 660 parts by weight

Ethylene glycol: 125 parts by weight

Trimethylolpropane: 80 parts by weight

In the same manner as in the case of the crosslinked polyester B-1, with the exception that the above materials were employed, synthesis was conducted to obtain a polyester resin having a THF-insoluble content of 0.3%, a molecular weight (of THF-soluble fraction) of 172000, Mw/Mn of 31.4, Ts of 78° C., Tfb of 136° C., T½ of 157° C., Tend of 168° C., an acid number of 5.2, and Tg (determined by the DSC measuring method) of 65.0° C.

Example 1

Preparation of the Toner

Straight-chain polyester A-1: 18 parts by weight

Crosslinked polyester B-1: 72 parts by weight

Carbon black

Black Pearls 460 (produced by Cabot Specialty Chemicals Incorporated): 5 parts by weight

*Content of polycyclic aromatic hydrocarbon: <12 ppm

Charge control agent (positive charge control agent)

Bontron N-04 (produced by Orient Chemical Industries Incorporated): 2 parts by weight Wax Purified carnauba wax No. 1 (produced by CERA RICA NODA Limited, acid number: 5): 2 parts by weight The above materials were mixed in a Henschel mixer, and were kneaded in a twin-screw kneader. The kneaded mixture obtained in this manner was pulverized and separated to produce a toner raw material having an average particle diameter of 10.1 μm.

100 Parts by weight of the resulting toner law material and 1 part of silica HDK3050EP (produced by Wacker Chemicals) were mixed in a Henschel mixer and separated to produce a toner a.

In the same manner as in Example 1, except for synthesizing in accordance with the formulations shown in Tables 1-1 and 1-2, toners a (Example 1) to m (Example 13) and toners y (Comparative Example 1) to bb (Comparative Example 4) were produced.

Preparation of Charge Control Agent Subjected to Forced Deaeration Treatment (Treated CCA)

The materials shown in Table 2 were mixed in a Henschel mixer and then agitated at a resin temperature of about 200° C. for one hour while being subjected to a forced deaeration treatment in a 3 liter heating kneader open system. After cooling to a resin temperature of about 120° C. and agitating for an additional 30 minutes, the resultant was removed, cooled and then crushed to produce forced deaeration-treated pulverized charge control agents (treated CCA (1) to treated CCA (4)) having a particle diameter of about 2 mm or less.

Employing these treated charge control agents, toners n (Example 14) to m (Example 24) and toner cc (Comparative Example 5) were produced in the same manner as in Example 1 except for synthesizing in accordance with the formulations shown in Tables 1-1 and 1-2.

As the colorant, 5 parts by weight of Black Pearls 460 were employed, excluding Examples 21 and 24.

In Example 21, 5 parts by weight of carbon black containing 15 ppm of a polycyclic aromatic hydrocarbon were employed.

In Example 24, 60 parts by weight of a magnetic powder (BL-200, produced by Titan Kogyo K. K.) was employed as the colorant in place of carbon black.

Preparation of the Developer

As shown in Tables 1-1 and 1-2, 3 parts by weight of the above toner and 97 parts by weight of a carrier (silica resin coated ferrite carrier) were mixed and agitated to produce developers (a+x) to (cc+x).

With regard to the toner of Example 24, a magnetic single-component developer was produced without mixing with the carrier.

TABLE 1

| | Formulation | | | | | | | | |
|---|---|---|---|---|---|---|---|---|---|
| Examples | First resin (A) | Second resin (B) | WAX | Charge control agent (CCA) | External additive | Others | Average particle diameter | Toner | Carrier |
| Example 1 | Polyester A-1 18 parts | Polyester B-1 72 parts | Carnauba wax 3 parts | N-04 2 parts | HDK3050EP 1 part | — | 10.1 μm | a | x |
| Example 2 | Polyester A-1 36 parts | Polyester B-3 54 parts | Carnauba wax 3 parts | N-04 2 parts | HDK3050EP 1 part | — | 9.9 μm | b | x |
| Example 3 | Polyester A-2 36 parts | Polyester B-2 54 parts | Carnauba wax 3 parts | N-04 2 parts | HDK3050EP 1 part | — | 10.0 μm | c | x |
| Example 4 | Polyester A-2 36 parts | Polyester B-3 54 parts | Carnauba wax 3 parts | N-04 2 parts | HDK3050EP 1 part | — | 10.2 μm | d | x |
| Example 5 | Polyester A-2 63 parts | Polyester B-4 27 parts | Carnauba wax 3 parts | N-04 2 parts | HDK3050EP 1 part | — | 10.4 μm | e | x |
| Example 6 | Polyester A-2 36 parts | Polyester B-2 54 parts | Carnauba wax 3 parts | N-84 2 parts | HDK3050EP 1 part | — | 10.1 μm | f | y |
| Example 7 | Polyester A-2 36 parts | Polyester B-2 54 parts | Wax 4 3 parts | N-04 2 parts | HDK3050EP 1 part | — | 10.1 μm | g | x |
| Example 8 | Polyester A-2 36 parts | Polyester B-2 54 parts | NPS-9210 3 parts | N-04 2 parts | HDK3050EP 1 part | — | 9.8 μm | h | x |
| Example 9 | Polyester A-2 36 parts | Polyester B-2 54 parts | Biscol 550P 3 parts | N-04 2 parts | HDK3050EP 1 part | — | 10.2 μm | i | x |
| Example 10 | Polyester A-2 35 parts | Polyester B-2 52 parts | Biscol 550P 3 parts | N-04 2 parts | HDK3050EP 1 part | WAX Sasol H1 1 part | 10.3 μm | j | x |
| Example 11 | Polyester A-2 36 parts | Polyester B-2 54 parts | Carnauba wax 3 parts | P-51 2 parts | HDK3050EP 1 part | — | 9.9 μm | k | x |
| Example 12 | Polyester A-2 36 parts | Polyester B-2 54 parts | Carnauba wax 3 parts | N-04 1.5 parts P-51 0.5 parts | HDK3050EP 1 part | — | 10.2 μm | l | x |
| Example 13 | Polyester A-3 45 parts | Polyester B-1 45 parts | Carnauba wax 3 parts | N-04 2 parts | HDK3050EP 1 part | — | 9.7 μm | m | x |
| Example 14 | Polyester A-2 35 parts | Polyester B-2 52 parts | Carnauba wax 3 parts | Treated CCA (1) 5 parts | HDK3050EP 1 part | — | 10.0 μm | n | x |
| Example 15 | Polyester A-2 35 parts | Polyester B-2 52 parts | Carnauba wax 3 parts | Treated CCA (1) 5 parts | PA-200HS 0.5 parts | — | 10.2 μm | o | x |
| Example 16 | Polyester A-2 35 parts | Polyester B-2 52 parts | Carnauba wax 3 parts | Treated CCA (1) 5 parts | TG-820F 0.5 part | — | 10.0 μm | p | x |
| Example 17 | Polyester A-2 35 parts | Polyester B-2 52 parts | Carnauba wax 3 parts | Treated CCA (1) 3.8 parts TP-415 0.5 parts | RA-200HS 0.5 part | — | 10.2 μm | q | x |
| Example 18 | Polyester A-2 35 parts | Polyester B-2 52 parts | Carnauba wax 3 parts | Treated CCA (2) 5 parts | HDK3050EP 1 part | — | 10.3 μm | r | x |
| Example 19 | Polyester A-2 35 parts | Polyester B-2 52 parts | Sasol H-1 wax 3 parts | Treated CCA (1) 2.5 parts CCA (8-1) 1 part | RA-200HS 0.5 part | — | 10.2 μm | s | x |
| Example 20 | Polyester A-2 35 parts | Polyester B-2 52 parts | Wax 4 3 parts | Treated CCA (1) 2.5 parts CCA (8-2) 1 part | RA-200HS 0.5 part | — | 10.1 μm | t | x |
| Example 21 | Polyester A-2 35 parts | Polyester B-2 52 parts | Carnauba wax 3 parts | Treated CCA (1) 5 parts | TG-820F 0.5 part | *1 | 10.0 μm | u | x |
| Example 22 | — | Polyester B-1 87 parts | Carnauba wax 3 parts | Treated CCA (3) 5 parts | RA-200HS 0.5 part | — | 10.1 μm | v | x |
| Example 23 | — | Polyester B-1 87 parts | Carnauba wax 3 parts | Treated CCA (3) 2.5 parts TP-415 0.7 parts | TG-820F 0.5 part | — | 10.2 μm | w | x |
| Example 24 | Polyester A-2 35 parts | Polyester B-2 52 parts | Carnauba wax 3 parts | Treated CCA (1) 5 parts | TG-820F 0.5 part | Magnetic powder BL-200 60 parts | 10.0 μm | x | — |
| Comp. Example 1 | Polyester A-2 90 parts | — | Carnauba wax 3 parts | N-04 2 parts | HDK3050EP 1 part | — | 9.6 μm | y | x |
| Comp. | — | Polyester B-6 | Carnauba wax | N-04 | HDK3050EP | — | 10.3 μm | z | x |

TABLE 1-continued

| Examples | First resin (A) | Second resin (B) | WAX | Charge control agent (CCA) | External additive | Others | Average particle diameter | Toner | Carrier |
|---|---|---|---|---|---|---|---|---|---|
| | | Formulation | | | | | | | |
| Example 2 | | 90 parts | 3 parts | 2 parts | 1 part | | | | |
| Comp. | Polyester A-2 | Polyester B-6 | Carnauba wax | N-04 | HDK3050EP | — | 10.0 μm | aa | x |
| Example 3 | 18 parts | 72 parts | 3 parts | 2 parts | 1 part | | | | |
| Comp. | Polyester A-2 | Polyester B-2 | Carnauba wax | N-04 | HDK3050EP | — | 10.1 μm | bb | x |
| Example 4 | 30 parts | 60 parts | 3 parts | 2 parts | 1 part | | | | |
| Comp. | — | Polyester B-2 | Carnauba wax | Treated CCA (4) | RA-200HS | — | 10.2 μm | cc | x |
| Example 5 | | 87 parts | 3 parts | 5 parts | 0.5 part | | | | |

TABLE 2

Formulation of charge control agent subjected to forced deaeration treatment (treated CCA)

| Examples | First resin (A) | Second resin (B) | CCA |
|---|---|---|---|
| Treated CCA (1) | Polyester A-2 24 parts | Polyester B-2 36 parts | N-04 40 parts |
| Treated CCA (2) | Polyester A-2 24 parts | Polyester B-2 36 parts | P-51 40 parts |
| Treated CCA (3) | — | Polyester B-1 60 parts | N-04 40 parts |
| Treated CCA (4) | — | Polyester B-2 60 parts | N-04 40 parts |

In Tables 1-1 and 1-2, the following products were employed.

Carnauba wax: purified carnauba wax No. 1 (acid number 5), produced by CERA RICA NODA Limited.

NPS-9210: higher aliphatic alcohol produced by Nippon Seiro Co., Ltd.

Viscol 550P: polypropylene wax produced by Sanyo Chemicals.

Sasol H-1: Fischer-Tropsch wax produced by Sasol Co., Ltd.

Wax 4: above chemical formula Wax 4

N-04: Bontrone N-04 produced by Orient Chemical.

E-84: Bontrone E-84, salicylic acid metal complex produced by Orient Chemical.

P-51: Bontrone P-51, quaternary ammonium salt produced by Orient Chemical (compound of chemical formula (1-1))

TP-415: quaternary ammonium salt (compound of the chemical formula (2-1)) produced by Hodogaya Chemical Industries Co., Ltd.

HDK3050EP: hydrophobic silica produced by Wacker chemicals Inc.

Surface treating agent: amino silicon oil

Bulk density 115 g/l, BET surface area: 130 $m^2/g$

RA-200HS: hydrophobic silica produced by Nippon Aerosil Co., Ltd.

Surface treating agent: hexamethyldisilazane and aminosilane

Bulk density 40 g/l, BET surface area: 140 $m^2/g$

TG-820F: hydrophobic silica produced by Cabot Specialty Chemicals Inc.

Surface treating agent: cyclic silzane

Bulk density 40 g/l, BET surface area: 210 $m^2/g$

Carrier x: silicone resin coated ferrite carrier

Carrier y: acrylic polyol resin coated ferrite carrier

*1: carbon black whose polycyclic aromatic hydrocarbon content is 15 ppm or more With respect to the toners obtained in the Examples and Comparative Examples described above, the viscosity characteristics were measured with a constant load extrusion type capillary rheometer and the glass transition point was measured using the DSC measuring method.

The apparent density was measured to obtain an index for fluidity of the toner. The larger the numerical value of the apparent density, the better the fluidity of the toner.

The apparent density was measured by the following procedure employing a bulk specific gravity meter produced by Kuramochi Kagaku Kiki Seisakusho.

(1) A toner passed through a sieve having a sieve opening diameter of 0.5 mm was gently dropped into a container of 22 mm in inner diameter, 80 mm in depth and 30 $cm^3$ in volume through a funnel of 40° in angle.

(2) The toner was allowed to stand for 30 seconds when the toner overflowed from the container.

(3) If the toner settled into the container while allowed to stand and the upper level of the toner became lower than the upper edge of the container, more toner was poured into the container.

(4) The excess toner above the upper level of the container was removed when the toner overflowed again from the container, thereby reducing the toner to the same height as that of the upper level of the container.

(5) The weight of the toner remaining finally in the container was measured, and the measured value was divided by the volume of the container to determine the apparent density.

The measurement results are shown in Table 3.

The contents and/or calculated values of aniline, tributylamine, molybdenum and polycyclic aromatic hydrocarbon in each toner are shown in Table 3.

The contents of aniline and tributylamine in the toner were determined by the Head Space Analysis method (150° C. for 60 minutes) according to gas chromatography. The contents of molybdenum and polycyclic aromatic hydrocarbon are calculated values from the amount of the polycyclic aromatic hydrocarbon and content of the polycyclic aromatic hydrocarbon in carbon black, respectively.

TABLE 3

Physical properties of toner

| Examples | Ts ° C. | Tfb ° C. | T1/2 ° C. | Tend ° C. | Tg ° C. | Aniline content ppm | TBA content Ppm | Mo content Mg/kg | Apparent density g/cm$^3$ |
|---|---|---|---|---|---|---|---|---|---|
| Example 1 | 62.2 | 88.4 | 118.1 | 122.2 | 57.5 | 15 | — | — | 0.50 |
| | (68.5) | (95.5) | (126.0) | (130.0) | | | | | |
| Example 2 | 63.6 | 97.8 | 134.0 | 143.5 | 53.2 | 13 | — | — | 0.50 |
| | (69.5) | (103.8) | (140.6) | (148.5) | | | | | |
| Example 3 | 71.3 | 97.8 | 125.3 | 133.3 | 61.0 | 12 | — | — | 0.50 |
| Example 4 | 72.0 | 96.8 | 123.3 | 132.8 | 60.8 | 16 | — | — | 0.50 |
| Example 5 | 72.3 | 96.5 | 115.3 | 125.1 | 58.8 | 12 | — | — | 0.50 |
| | (79.0) | (104.2) | (122.9) | (132.8) | | | | | |
| Example 6 | 70.8 | 97.3 | 125.0 | 132.9 | 60.8 | — | — | — | 0.50 |
| Example 7 | 72.4 | 99.0 | 127.1 | 135.5 | 62.5 | 14 | — | — | 0.50 |
| Example 8 | 69.6 | 98.0 | 126.3 | 134.5 | 60.0 | 13 | — | — | 0.50 |
| Example 9 | 71.1 | 97.3 | 125.2 | 133.0 | 63.8 | 12 | — | — | 0.49 |
| Example 10 | 74.0 | 99.5 | 127.5 | 135.6 | 63.5 | 13 | — | — | 0.50 |
| Example 11 | 71.0 | 97.6 | 124.8 | 134.8 | 61.0 | — | 210 | — | 0.50 |
| Example 12 | 71.5 | 98.4 | 126.2 | 135.2 | 60.5 | 11 | 170 | — | 0.50 |
| | (77.0) | (105.9) | (133.2) | (143.1) | | | | | |
| Example 13 | 73.0 | 96.7 | 120.2 | 129.2 | 62.3 | 17 | — | — | 0.50 |
| Example 14 | 72.3 | 98.6 | 123.5 | 135.2 | 62.0 | 2 | — | — | 0.50 |
| Example 15 | 71.8 | 97.8 | 125.2 | 133.8 | 62.3 | 1 | — | — | 0.50 |
| | (76.9) | (104.9) | (132.5) | (140.0) | | | | | |
| Example 16 | 70.6 | 98.3 | 124.5 | 135.9 | 62.2 | 1 | — | — | 0.52 |
| Example 17 | 69.5 | 96.6 | 123.8 | 133.8 | 61.9 | 1 | — | 2400 | 0.50 |
| Example 18 | 71.0 | 97.8 | 125.8 | 136.8 | 62.0 | — | 25 | — | 0.50 |
| | (77.1) | (104.5) | 133.6 | 143.8 | | | | | |
| Example 19 | 71.5 | 96.9 | 125.3 | 135.6 | 61.8 | 1 | — | — | 0.49 |
| Example 20 | 69.0 | 96.6 | 124.8 | 134.0 | 62.0 | 2 | — | — | 0.50 |
| | (75.2) | (103.2) | (132.0) | (142.7) | | | | | |
| Example 21 | 71.5 | 98.6 | 126.8 | 136.8 | 62.5 | 1 | — | — | 0.52 |
| Example 22 | 73.0 | 102.5 | 131.5 | 140.8 | 60.5 | 2 | — | — | 0.50 |
| | (79.0) | (107.8) | (138.7) | (146.9) | | | | | |
| Example 23 | 72.5 | 102.8 | 132.0 | 141.5 | 60.4 | 1 | — | 3400 | 0.52 |
| | (78.5) | (108.5) | (138.8) | (147.0) | | | | | |
| Example 24 | 71.5 | 97.8 | 125.5 | 135.6 | 62.0 | 1 | — | — | 0.60 |
| Comp. | 72.6 | 82.2 | 93.8 | 101.0 | 58.5 | 16 | — | — | 0.50 |
| Example 1 | (78.2) | (88.5) | (101.1) | (108.5) | | | | | |
| Comp. | 68.2 | 117.5 | 141.3 | 150.1 | 64.7 | 14 | — | — | 0.50 |
| Example 2 | (74.7) | (123.0) | (148.6) | (156.8) | | | | | |
| Comp. | 69.5 | 108.5 | 137.3 | 143.0 | 63.0 | 17 | — | — | 0.50 |
| Example 3 | (75.1) | (116.6) | (145.6) | (151.5) | | | | | |
| Comp. | 72.5 | 106.3 | 140.1 | 145.3 | 62.0 | 15 | — | — | 0.50 |
| Example 4 | (78.8) | (112.5) | (146.8) | (152.9) | | | | | |
| Comp. | 82.5 | 116.0 | 157.5 | 172.8 | 63.2 | 1 | — | — | 0.50 |
| Example 5 | (87.2) | (123.1) | (163.5) | (177.1) | | | | | |

Measuring Conditions for Constant Load Extrusion Type Capillary Rheometer

Piston cross-sectional area: 1 cm$^2$

Cylinder pressure: 0.98 MPa

Die length: 1 mm, Die pore diameter: 1 mm

Measuring initiation temperature: 50° C.

Temperature elevating speed: 6° C./min, the value in the parenthesis represents a measured value at a temperature elevating speed of 10° C./min.

Sample weight: 1.5 g

TBA: tributylamine

Mo: molybdenum

Offset Generation Temperature

Except for Examples 6 and 24, a belt-shaped unfixed image sample (2 cm in width and 20 cm in length) was produced on an A4 size paper, using a printer obtained by remodeling a commercially available laser beam printer (equipped with a selenium photosensitive medium). The presence or absence of the offset phenomenon were evaluated using a heat roller fixation unit of the type described below.

With respect to the toner of Example 6, the same unfixed image sample was produced employing a printer obtained by remolding a commercially available laser beam printer (OPC photosensitive medium), and then the evaluation was conducted.

With respect to the toner of Example 24, the same unfixed image sample was produced employing a printer obtained by remolding a commercially available magnetic single-component system printer, and then the evaluation was conducted.

TABLE 4

Fixing conditions

| | Condition 1 | Condition 2 |
|---|---|---|
| Roller material | | |
| Upper | Ethylene fluoride | Ethylene fluoride |
| Lower | HTV silicon | HTV silicon |
| Roller shape | | |
| Diameter | 50 mm | 50 mm |
| Length | 370 mm | 370 mm |
| Upper roller load | 15 kg | 25 kg |

TABLE 4-continued

| Fixing conditions | Condition 1 | Condition 2 |
|---|---|---|
| Upper/lower roller nip width | 8 mm | 10 mm |
| Paper feed rate | 90 mm/sec | 800 mm/sec |

The offset initiation temperature refers to a temperature at which the offset phenomenon is visually observed during the observation of the fixed image sample.

Peel Fixation Strength

The same unfixed image as that of the anti-offset test was produced by employing the above copying machine obtained by remolding a commercially available copying machine.

The unfixed image was fixed by changing the fixing temperature under the condition 2 shown in Table 4.

A mending tape (810 produced by Sumitomo 3M Co., Ltd.) was applied to the fixed image under a fixed pressure, and then peeled off from a fixed direction at a fixed speed.

The fixation strength was determined from the image density residual ratio calculated by the formula given below. The image density was evaluated employing a Macbeth image densitometer RD-918.

Peel fixation strength test residual ratio=image density after the peel test/image density before the peel test A residual ratio of 80% or more was taken to be a sufficient level of peel fixation strength in practical use. The minimum temperature was employed as the peel fixation initiation temperature.

Rubbing Fixation Strength

Employing the same fixed image fixed in the same manner as in case of the peel fixation strength test, the fixed image was rubbed by employing a vibration-type abrasion fastness testing apparatus (rubbing body: Whatman filter paper No. 42, load: 500 g, abrasion operation: 20 strokes).

The rubbing fixation strength was determined from the image density residual ratio calculated by the formula given below. The image density was evaluated employing a Macbeth image densitometer RD-918.

Rubbing fixation strength test density residual ratio=image density after the rubbing test/image density before the rubbing test A residual ratio of 80% or more was taken to be a sufficient level of rubbing fixation strength in practical use. The minimum temperature was employed as the rubbing fixation initiation temperature.

The above-described evaluation results are shown in Table 5.

TABLE 5

Offset initiation temperature, fixation initiation temperature

| Examples | Offset initiation temperature ° C. (Condition 1) | Fixation initiation temperature ° C. (Condition 2) | Peel fixation initiation temperature ° C. (Condition 2) | Rubbing fixation initiation temperature ° C. (Condition 2) |
|---|---|---|---|---|
| Example 1 | 180 | >200 | 135 | 135 |
| Example 2 | >200 | >200 | 120 | 120 |
| Example 3 | 185 | >200 | 135 | 130 |
| Example 4 | 195 | >200 | 135 | 135 |
| Example 5 | 190 | >200 | 135 | 130 |

TABLE 5-continued

Offset initiation temperature, fixation initiation temperature

| Examples | Offset initiation temperature ° C. (Condition 1) | Fixation initiation temperature ° C. (Condition 2) | Peel fixation initiation temperature ° C. (Condition 2) | Rubbing fixation initiation temperature ° C. (Condition 2) |
|---|---|---|---|---|
| Example 6 | 195 | >200 | 145 | 145 |
| Example 7 | 200 | >200 | 135 | 130 |
| Example 8 | 200 | >200 | 135 | 130 |
| Example 9 | 175 | 200 | 150 | 150 |
| Example 10 | 180 | >200 | 145 | 145 |
| Example 11 | 195 | >200 | 135 | 130 |
| Example 12 | 195 | >200 | 135 | 135 |
| Example 13 | 175 | 200 | 145 | 150 |
| Example 14 | 195 | >200 | 135 | 130 |
| Example 15 | 195 | >200 | 135 | 130 |
| Example 16 | 200 | >200 | 135 | 130 |
| Example 17 | 200 | >200 | 130 | 130 |
| Example 18 | >200 | >200 | 135 | 130 |
| Example 19 | 195 | >200 | 135 | 135 |
| Example 20 | 200 | >200 | 130 | 130 |
| Example 21 | 200 | >200 | 135 | 130 |
| Example 22 | >200 | >200 | 140 | 140 |
| Example 23 | >200 | >200 | 140 | 135 |
| Example 24 | 195 | >200 | 140 | 135 |
| Comp. Example 1 | 120 | 140 | 100 | 105 |
| Comp. Example 2 | >200 | >200 | 165 | 165 |
| Comp. Example 3 | >200 | >200 | 160 | 160 |
| Comp. Example 4 | >200 | >200 | 155 | 155 |
| Comp. Example 5 | >200 | >200 | 175 | 170 |

Printing Test

The printing quality resulting from continuous printing employing a commercially available laser beam printer (equipped with a selenium photosensitive medium) was evaluated, and the amount of charge of the developer was measured.

With respect to Example 6, the same evaluation was carried out employing a commercially available laser beam printer (OPC photosensitive medium).

The amount of charge was measured by means of a blowoff charge amount measuring apparatus. The image density was measured employing a Macbeth densitometer RD-918, while fogging (=background) was determined from the difference between the white background image density and the white paper density prior to printing.

The replenishment of toner during continuous printing was automatically conducted by filling the toner replenishment hopper of the machine with toner after the addition of silica.

With respect to the toner of Example 24, a commercially available magnetic single-component developing printer was remodeled and a test was conducted. With respect to the amount of charge, toner was recovered from the interior of the developing apparatus after each copy was made, and a developer was produced which contains the toner and a carrier (a silicone resin-coated ferrite carrier) in the ratio of 5/95 (weight ratio), and measurement was conducted in a manner similar to the other two component developers.

Amount of Scattered Toner

The interior of the machine was inspected after printing 50 KP (50,000 pages) and 100 KP (100,000 pages), and the amount of contamination by scattered toner on the photosensitive medium and the peripheral parts of the developing apparatus was evaluated; when there was almost no such contamination, this is indicated by ○, some contamination is indicated by Δ, and severe contamination is indicated by X.

The surface of the photosensitive medium was inspected after printing 100 KP (100,000 pages), and the adhesion of silica was evaluated; when there was almost no film of silica formed on the surface of the photosensitive medium, this is indicated by ○, and some adhesion of silica is indicated by Δ.

The above-described evaluation results are shown in Tables 6-1 and 6-2.

TABLE 6-1

| Evaluation results | | | | | | | | |
|---|---|---|---|---|---|---|---|---|
| | Charge amount | | | | Image density | | | |
| Examples | Initial | 10 K | 50 K | 100 K | Initial | 10 K | 50 K | 100 K |
| Example 1 | 20 | 20 | 19 | 20 | 1.4 | 1.4 | 1.4 | 1.4 |
| Example 2 | 18 | 19 | 20 | 21 | 1.5 | 1.5 | 1.4 | 1.4 |
| Example 3 | 18 | 18 | 17 | 19 | 1.5 | 1.5 | 1.6 | 1.4 |
| Example 4 | 20 | 21 | 19 | 20 | 1.4 | 1.4 | 1.4 | 1.4 |
| Example 5 | 18 | 19 | 19 | 20 | 1.5 | 1.4 | 1.4 | 1.4 |
| Example 6 | −24 | −25 | −25 | −25 | 1.6 | 1.6 | 1.6 | 1.6 |
| Example 7 | 23 | 23 | 23 | 24 | 1.3 | 1.3 | 1.3 | 1.3 |
| Example 8 | 17 | 17 | 18 | 19 | 1.5 | 1.5 | 1.5 | 1.5 |
| Example 9 | 17 | 17 | 18 | 18 | 1.5 | 1.5 | 1.5 | 1.5 |
| Example 10 | 22 | 22 | 21 | 21 | 1.3 | 1.3 | 1.4 | 1.4 |
| Example 11 | 15 | 14 | 13 | 12 | 1.6 | 1.6 | 1.6 | 1.7 |
| Example 12 | 17 | 17 | 17 | 17 | 1.8 | 1.5 | 1.5 | 1.5 |
| Example 13 | 18 | 18 | 17 | 17 | 1.5 | 1.5 | 1.5 | 1.5 |

| | Fogging | | | | Amount of scattered toner | | Filming of photo-sensitive medium, |
|---|---|---|---|---|---|---|---|
| Examples | Initial | 10 K | 50 K | 100 K | 50 K | 100 K | 100 K |
| Example 1 | ○ | ○ | ○ | Δ | ○ | Δ | Δ |
| Example 2 | Δ | ○ | ○ | Δ | Δ | Δ | Δ |
| Example 3 | ○ | ○ | ○ | Δ | ○ | Δ | Δ |
| Example 4 | ○ | ○ | ○ | Δ | ○ | Δ | Δ |
| Example 5 | Δ | ○ | ○ | Δ | Δ | Δ | Δ |
| Example 6 | ○ | ○ | ○ | Δ | ○ | Δ | Δ |
| Example 7 | ○ | ○ | ○ | Δ | ○ | Δ | Δ |
| Example 8 | ○ | ○ | ○ | Δ | ○ | Δ | Δ |
| Example 9 | ○ | ○ | ○ | × | ○ | × | Δ |
| Example 10 | ○ | ○ | ○ | × | ○ | × | ○ |
| Example 11 | ○ | ○ | ○ | Δ | ○ | Δ | Δ |
| Example 12 | ○ | ○ | ○ | Δ | ○ | Δ | Δ |
| Example 13 | ○ | ○ | ○ | Δ | ○ | Δ | Δ |

TABLE 6-2

| Evaluation results | | | | | | | | |
|---|---|---|---|---|---|---|---|---|
| | Charge amount | | | | Image density | | | |
| Examples | Initial | 10 K | 50 K | 100 K | Initial | 10 K | 50 K | 100 K |
| Example 14 | 20 | 20 | 21 | 22 | 1.6 | 1.6 | 1.5 | 1.4 |
| Example 15 | 20 | 20 | 21 | 21 | 1.6 | 1.6 | 1.5 | 1.4 |
| Example 16 | 19 | 19 | 20 | 20 | 1.6 | 1.6 | 1.6 | 1.5 |
| Example 17 | 23 | 23 | 23 | 22 | 1.6 | 1.6 | 1.6 | 1.6 |
| Example 18 | 15 | 14 | 13 | 13 | 1.6 | 1.6 | 1.6 | 1.7 |
| Example 19 | 20 | 20 | 19 | 19 | 1.6 | 1.6 | 1.6 | 1.5 |
| Example 20 | 17 | 18 | 18 | 20 | 1.6 | 1.6 | 1.5 | 1.5 |
| Example 21 | 19 | 19 | 18 | 16 | 1.6 | 1.6 | 1.5 | 1.4 |
| Example 22 | 19 | 19 | 20 | 20 | 1.5 | 1.6 | 1.6 | 1.5 |
| Example 23 | 19 | 19 | 19 | 19 | 1.6 | 1.6 | 1.6 | 1.6 |
| Example 24 | 15 | 14 | 13 | 13 | 1.4 | 1.6 | 1.5 | 1.5 |
| Comp. Example 1 | * | | | | | | | |
| Comp. Example 2 | 16 | 17 | 18 | 19 | 1.6 | 1.6 | 1.5 | 1.4 |
| Comp. Example 3 | 18 | 18 | 18 | 19 | 1.5 | 1.5 | 1.5 | 1.4 |
| Comp. Example 4 | 17 | 18 | 18 | 19 | 1.6 | 1.5 | 1.5 | 1.4 |
| Comp. Example 5 | 22 | 22 | 21 | 21 | 1.3 | 1.3 | 1.4 | 1.4 |

| | Fogging | | | | Amount of scattered toner | | Filming of photo-sensitive medium, |
|---|---|---|---|---|---|---|---|
| Examples | Initial | 10 K | 50 K | 100 K | 50 K | 100 K | 100 K |
| Example 14 | ○ | ○ | ○ | ○ | ○ | ○ | Δ |
| Example 15 | ○ | ○ | ○ | ○ | ○ | ○ | ○ |
| Example 16 | ○ | ○ | ○ | ○ | ○ | ○ | ○ |
| Example 17 | ○ | ○ | ○ | ○ | ○ | ○ | ○ |
| Example 18 | ○ | ○ | ○ | ○ | ○ | ○ | Δ |
| Example 19 | ○ | ○ | ○ | ○ | ○ | ○ | ○ |
| Example 20 | ○ | ○ | ○ | ○ | ○ | ○ | ○ |
| Example 21 | ○ | ○ | ○ | Δ | ○ | Δ | ○ |
| Example 22 | ○ | ○ | ○ | ○ | ○ | ○ | ○ |
| Example 23 | ○ | ○ | ○ | Δ | ○ | Δ | ○ |
| Example 24 | ○ | ○ | ○ | ○ | ○ | ○ | ○ |
| Comp. Example 1 | | | | | | | |
| Comp. Example 2 | ○ | ○ | ○ | Δ | ○ | Δ | Δ |

TABLE 6-2-continued

| | Evaluation results | | | | | | |
|---|---|---|---|---|---|---|---|
| Comp. Example 3 | ○ | ○ | ○ | Δ | ○ | Δ | Δ |
| Comp. Example 4 | ○ | ○ | ○ | Δ | ○ | Δ | Δ |
| Comp. Example 5 | ○ | ○ | ○ | ○ | ○ | ○ | ○ |

The results indicated in Tables 6-1 and 6-2 are explained hereinbelow.

The test was terminated because hot offset occurred at the beginning of the test in Comparative Example 1.

"Charge Amount": $\mu$C/g

"Fogging": ○: less than 0.01, Δ: 0.01–less than 0.03, X: 0.03 or more

"Scattering of Toner": visual evaluation after printing 50 kP (50,000 pages) and 100 kP (100,000 pages)

○: Almost no scattering

Δ: Some contamination as a result of scattering

X: Severe scattering

As is clear from Tables 3, 5, 6-1 and 6-2, a toner having a flow beginning temperature within a range of 70–105° C. and a flow ending temperature within a range of 120–144° C. reconciles the fixation properties at low temperatures and the anti-offset properties at high temperatures, and exhibits excellent fixation strength in a high-speed electrostatic image developing apparatus whose fixing speed exceeds 20 m/min.

In Comparative Example 1, the flow ending temperature was lower than that within a range defined in the present invention. This toner is superior in fixation strength and anti-offset properties at low temperatures, but the anti-offset properties at high temperatures are drastically lowered.

In Comparative Example 3, the flow beginning temperature was higher than that of the range defined in the present invention. This toner is superior in anti-offset properties at high temperatures and toughness, but the anti-offset properties at low temperatures and fixation strength are lowered. When fixing at high speed, a high fixation temperature is particularly required.

Sufficient properties can be obtained by employing a conventionally known releasing agent. Among these, a toner employing a releasing agent containing as a chief component a higher fatty acid ester and/or an aliphatic alcohol compound exhibits good releasability between the image and paper after fixing because of its sharp melting properties and markedly contributes to the anti-offset properties at high temperatures in an apparatus capable of fixing at high speed. When employing these releasing agents, since the friction coefficient of the surface of the fixed image becomes smaller and the abrasion resistance is improved, color transfer to the member and abrasion of the image are suppressed, thereby making it possible to maintain good printing quality.

Even when employing a Fischer-Tropsch wax, the same effect can be obtained.

As is apparent by observation using a microscope, these releasing agents have good dispersibility within the polyester resin and scattering of toner which is caused by poor dispersion decreases.

What is claimed is:

1. A toner for electrostatic image development comprising a polyester resin, a colorant, and a releasing agent, wherein the flow beginning temperature Tfb of the toner as measured using a constant load extrusion type capillary rheometer is within a range of 70–105° C. and the flow ending temperature Tend is within a range of 120–144° C.

2. A toner for electrostatic image development according to claim 1, wherein said polyester resin is a mixture of:

(A) a first resin having a straight-chain or crosslinked structure in which T½ as measured using the constant load extrusion type capillary rheometer is within a range of 70–130° C. and the glass transition point Tg is within a range of 45–75° C., and (B) a second resin having a crosslinked structure in which T½ as measured using the constant load extrusion type capillary rheometer is within a range of 130–210° C. and the glass transition point Tg is within a range of 45–75° C.

3. A toner for electrostatic image development according to claim 2, wherein a weight ratio of said first resin (A) to said second resin (B), (A)/(B), is within a range of 1/9 to 9/1.

4. A toner for electrostatic image development according to claim 3, which satisfies the expression:

$$20^\circ\ \text{C.} \leqq T\tfrac{1}{2}\ (\text{B}) - T\tfrac{1}{2}\ (\text{A}) \leqq 120^\circ\ \text{C.}$$

where T½ (B) and T½ (A) respectively represent ½-process melting temperatures of said first resin (A) and said second resin (B) as measured using the constant load extrusion type capillary rheometer.

5. A toner for electrostatic image development according to claim 4, wherein the weight-average molecular weight Mw of said first resin (A) as measured by GPC is within a range of 3000–50000 and Mw/Mn is 8 or less and, moreover, Mw of a component soluble in THF of said second resin (B) is within a range of 100000–400000 and Mw/Mn is 10 or more.

6. A toner for electrostatic image development according to claim 1, wherein said releasing agent is a wax containing as a chief component a higher fatty acid ester compound, an aliphatic alcohol compound and/or a Fischer-Tropsch wax.

7. A toner for electrostatic image development according to claim 1, wherein said colorant is carbon black and the content of a polycyclic aromatic hydrocarbon in said carbon black is 15 ppm or less.

8. A toner for electrostatic image development according to claim 1, further comprising a charge control agent.

9. A toner for electrostatic image development according to claim 8, wherein said charge control agent contains a nigrosine dye and a quaternary ammonium salt compound.

10. A toner composition for electrostatic image development according to claim 9, wherein said quaternary ammonium salt compound is at least one selected from the group consisting of the compounds of general formulae (1), (2) and (3) below:

General formula 1

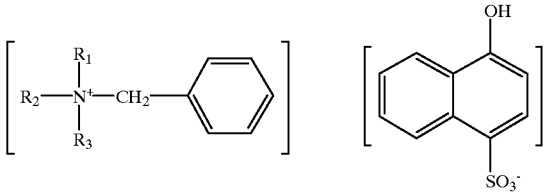

(in the formula, $R_1$ to $R_3$ indicate $C_nH_{2n+1}$ groups, wherein n is an integer within a range of 1 to 10, and $R_1$ to $R_3$ may differ).

General formula 2

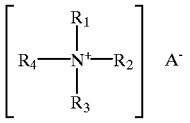

(in the formula, $R_1$, $R_2$, $R_3$, and $R_4$ represent, respectively and independently, a hydrogen atom, an alkyl group or alkenyl group having a number of carbons within a range of 1 to 22, an unsubstituted or substituted aromatic group having a number of carbons within a range of 1 to 20, and an aralkyl group having a number of carbons within a range of 7 to 20; $A^-$ indicates a molybdic acid anion or a tungstic acid anion, or a heteropolyacid anion containing molybdenum or tungsten atoms.)

General formula 3

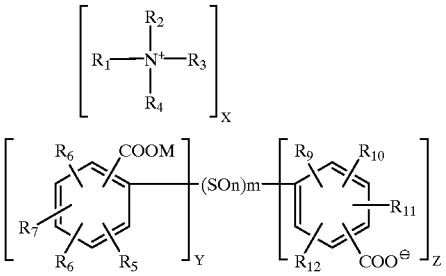

(in the formula, m represents 1, 2 or 3; n represents 0, 1 or 2; M represents a hydrogen atom or a monovalent metal ion; X and Z represent 1 or 2; and Y represents 0 or 1; Y is 1 and Z is 1 when X is 1; and Y is 0 and Z is 2 when X is 2; $R_5$–$R_{12}$ represent hydrogen, a straight-chain or branched, saturated or unsaturated alkyl group having a number of carbons within a range of 1–30, an alkoxylene group having a number of carbons within a range of 1 to 4 or a polyalkyloxylene group represented by the general formula (—$C_{2-5}$ alkylene-O)n-R (provided that R is hydrogen or an alkyl or acyl group having a number of carbons within a range of 1–4, and n is an integer within a range of 1–10); $R_1$, $R_2$, $R_3$ and $R_4$ represent hydrogen, a straight-chain or branched, saturated or unsaturated alkyl group having a number of carbons within a range of 1–30, an oxyethyl group represented by the general formula (—$CH_2$—$CH_2$—O)n-R (provided that R is hydrogen or an alkyl or acyl group having a number of carbons within a range of 1–4, and n is an integer within a range of 1–10), or a mononuclear or polynuclear alicyclic residue, mononuclear or polynuclear aromatic residue or mononuclear or polynuclear aliphatic residue having a number of carbons within a range of 5–12).

11. A toner for electrostatic image development according to claim 1, wherein a content of a volatile amine compound in said toner is 150 ppm or less.

12. A toner for electrostatic image development according to claim 11, wherein said volatile amine compound is aniline and/or tributylamine, the content of aniline contained in said toner is 10 ppm or less, and the content of tributylamine is 150 ppm or less.

13. A toner for electrostatic image development according to claim 1, wherein a content of molybdenum in said toner is 5000 mg/kg or less.

14. A toner for electrostatic image development according to claim 1, wherein a hydrophobic silica having a bulk density of 100 g/l and a BET surface area within a range of 100–250 $m^2/g$ is further deposited on the toner surface.

15. A toner for electrostatic image development according to claim 14, wherein said hydrophobic silica is silica whose surface is treated with hexamethyldisilazane, aminosilane and/or cyclic silazane.

16. A toner for electrostatic image development according to claim 1, which contains a magnetic powder as the colorant.

17. A toner for electrostatic image development according to claim 1, further comprising as a carrier a resin-coated magnetic carrier coated with one or more resins selected from silicone resin, fluororesin, and (meth)acrylic resin.

18. An electrostatic image forming method, comprising employing the toner for electrostatic image development of claim 1 at a fixing speed of 20 m/min or more.

19. An electrostatic image forming method, comprising employing the toner for electrostatic image development of claim 1 at a fixing speed of 30 mn/min or more.

* * * * *